US011479042B2

(12) United States Patent
Bandoh

(10) Patent No.: US 11,479,042 B2
(45) Date of Patent: Oct. 25, 2022

(54) LIQUID DISCHARGE HEAD, HEAD MODULE, HEAD DEVICE, LIQUID DISCHARGE DEVICE, AND LIQUID DISCHARGE APPARATUS

(71) Applicant: Ricoh Company, Ltd., Tokyo (JP)

(72) Inventor: Yoshinori Bandoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 403 days.

(21) Appl. No.: 16/655,476

(22) Filed: Oct. 17, 2019

(65) Prior Publication Data

US 2020/0156374 A1 May 21, 2020

(30) Foreign Application Priority Data

Nov. 15, 2018 (JP) ..... JP2018-214373
Oct. 1, 2019 (JP) ..... JP2019-181204

(51) Int. Cl.
*B41J 2/15* (2006.01)

(52) U.S. Cl.
CPC ..... *B41J 2/15* (2013.01); *B41J 2202/11* (2013.01); *B41J 2202/19* (2013.01); *B41J 2202/20* (2013.01)

(58) Field of Classification Search
CPC ..... B41J 2/15; B41J 2202/11; B41J 2202/19; B41J 2202/20
See application file for complete search history.

(56) References Cited

U.S. PATENT DOCUMENTS

2018/0281450 A1* 10/2018 Suzuki ..... B41J 2/2146
2019/0275797 A1 9/2019 Kato

FOREIGN PATENT DOCUMENTS

JP 2003-127385 5/2003
JP 2003-145775 5/2003
JP 2003-311963 11/2003

* cited by examiner

*Primary Examiner* — Justin Seo
(74) *Attorney, Agent, or Firm* — Harness, Dickey & Pierce, P.L.C.

(57) ABSTRACT

A liquid discharge head includes a plurality of nozzle arrays arranged in a first direction. The plurality of nozzle arrays each includes nozzles from which a liquid is discharged, the nozzles arranged in a second direction intersecting the first direction, and one of two nozzle arrays of the plurality of nozzle arrays adjacent to each other in the first direction include at least two nozzles arranged at different nozzle intervals from corresponding nozzles of another of the two nozzle arrays in the first direction.

13 Claims, 29 Drawing Sheets

LIQUID DISCHARGE HEAD, HEAD MODULE, HEAD DEVICE, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-214373, filed on Nov. 15, 2018, and Japanese Patent Application No. 2019-181204, filed on Oct. 1, 2019, in the Japan Patent Office, the entire disclosure of each of which is hereby incorporated by reference herein.

BACKGROUND

Technical Field

An aspect of the present disclosure relates to a liquid discharge head, a head module, a head device, a liquid discharge device, and a liquid discharge apparatus.

Related Art

A liquid discharge head includes a plurality of nozzles from which a liquid is discharged. The plurality of nozzles is arrayed in a nozzle array direction. When the liquid discharge head discharges liquid droplets with high-density (with high-frequency) from a large number of nozzles as in a solid image, a landing position of a discharged droplet may be deviated from a target landing position due to an interference between a self-airflow generated by the discharged liquid droplet, or an interference between the self-airflow and an airflow accompanied with a conveyance of a medium on which the liquid is applied. Hereinafter, "the medium on which the liquid is applied" is simply referred to as "the medium". The deviation of the landing position of the liquid droplet from the target landing position may cause an abnormal image such as wind ripples or edge distortion.

Thus, the liquid discharge head includes nozzles arranged so that an interval between adjacent nozzles at an end portion of the liquid discharge head is made wider than an interval between adjacent nozzles at a central portion of the liquid discharge head in the nozzle array direction.

SUMMARY

In an aspect of this disclosure, a liquid discharge head includes a plurality of nozzle arrays arranged in a first direction. The plurality of nozzle arrays each includes nozzles from which a liquid is discharged, the nozzles arranged in a second direction intersecting the first direction, and one of two nozzle arrays of the plurality of nozzle arrays adjacent to each other in the first direction include at least two nozzles arranged at different nozzle intervals from corresponding nozzles of another of the two nozzle arrays in the first direction.

In another aspect of this disclosure, a liquid discharge apparatus includes a liquid discharge head configured to discharge a liquid, and a conveyor configured to convey a medium, onto which the liquid discharged from the liquid discharge head is applied, in a conveyance direction. The liquid discharge head includes a plurality of nozzle arrays arranged in a first direction perpendicular to the conveyance direction, the plurality of nozzle arrays each includes nozzles from which the liquid is discharged, the nozzles arranged in a second direction intersecting the first direction, and one of two nozzle arrays of the plurality of nozzle arrays adjacent to each other in the first direction includes at least two nozzles arranged at different nozzle intervals from corresponding nozzles of another of the two nozzle arrays in the first direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
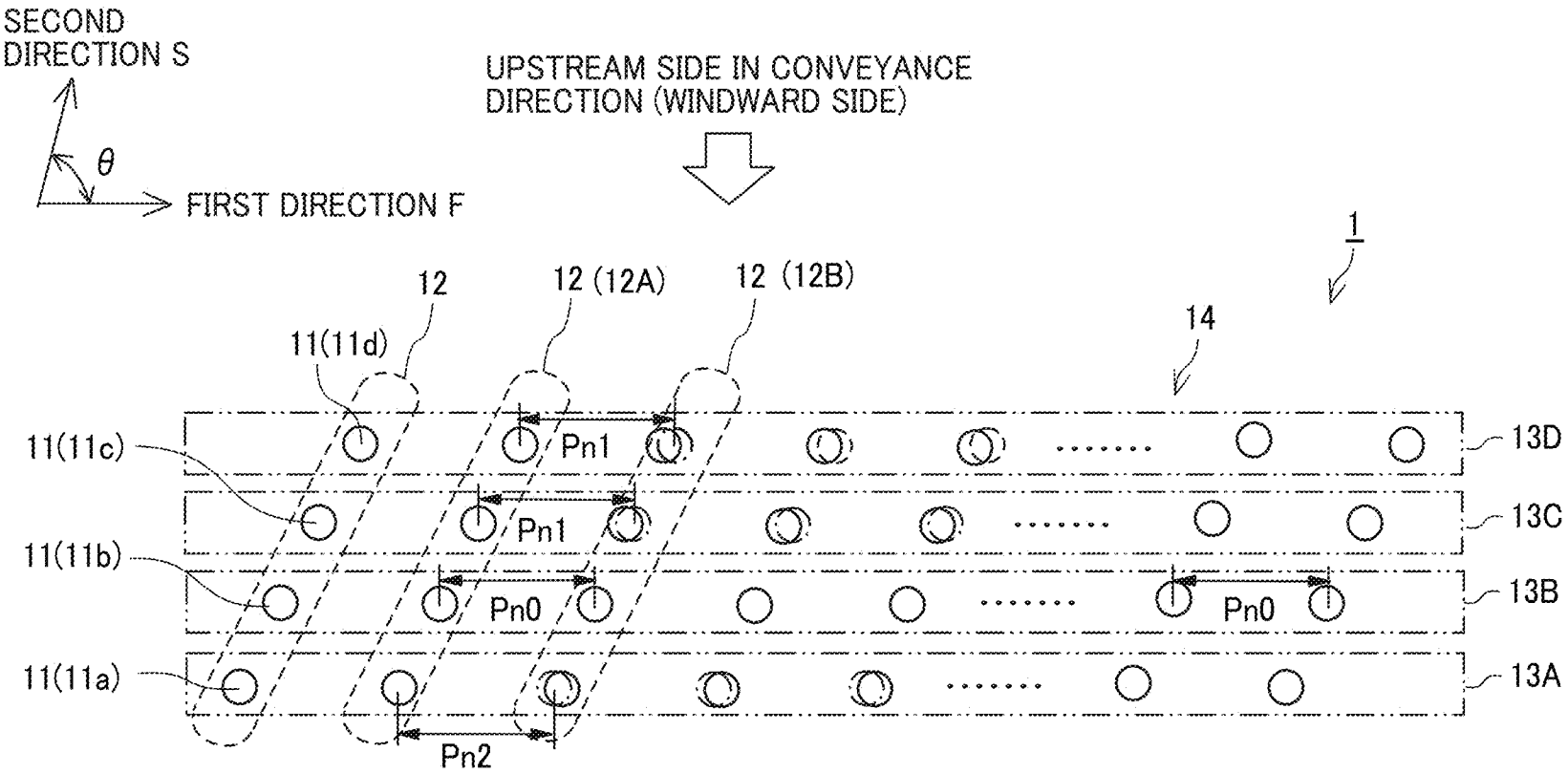
FIG. 1 is a schematic plan view of a nozzle arrangement of a liquid discharge head according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Embodiments of the present disclosure are described below with reference to the attached drawings. FIG. 1 illustrates a first embodiment of the present disclosure. FIG. 1 is a schematic plan view of a nozzle arrangement of a liquid discharge head according to the first embodiment.

The liquid discharge head 1 has a plurality of nozzle arrays 12 in which a plurality of nozzles 11 (11*a* to 11*d*) are arrayed in a second direction S. The plurality of nozzle arrays 12 are arranged side by side in a first direction F that intersects the second direction S. Hereinafter, the "liquid discharge head" is simply referred to as the "head".

Here, the second direction S is a direction that obliquely intersects the first direction F at an angle θ. A group of nozzles 11 arranged in the first direction F is referred to as a stage 13, and a group of stages 13A to 13D is referred to as a nozzle array group 14. The stage 13A is a group of nozzles 11*a* of each nozzle array 12. Similarly, the stage 13B is a group of nozzles 11*b* of each nozzle array 12, the stage 13C is a group of nozzles 11*c* of each nozzle array 12, and the stage 13D is a group of nozzles 11*d* of each nozzle array 12.

Two nozzle arrays 12A and 12B are adjacent with each other in the first direction F. A "nozzle interval Pn" is an interval between the nozzle 11 of one of the nozzle array 12A and the nozzle 11 of another nozzle array 12B arranged adjacent in the first direction F in the head 1.

Further, the nozzle interval Pn includes a nozzle interval Pn1 that is wider than a preset nozzle interval Pn0 and a nozzle interval Pn2 that is narrower than the nozzle interval Pn0 (Pn1>Pn0>Pn2).

At least one nozzle array 12 among the plurality of nozzle arrays 12 includes at least two nozzles 11 arranged at different nozzle intervals Pn.

Thus, as illustrated in FIG. 1, the head 1 includes a plurality of nozzle arrays 12 arranged in a first direction F. The plurality of nozzle arrays 12 each includes nozzles 11 from which a liquid is discharged, the nozzles 11 arranged in a second direction S intersecting the first direction F. One of two nozzle arrays 12 of the plurality of nozzle arrays 12 adjacent to each other in the first direction F include at least two nozzles 11*a* to 11*d* arranged at different nozzle intervals (Pn0, Pn1, and Pn2) from corresponding nozzles 11 of another of the two nozzle arrays 12 in the first direction F.

Further, two nozzle arrays 12 of the plurality of nozzle arrays 12 arranged at an end part of the head 1 in the first direction F. The two nozzle arrays 12 includes first nozzles 11*d* arranged at a first nozzle interval (Pn1) wider than a nozzle interval (Pn0) of the nozzles 11*b* arranged at a central part of the head 1 in the first direction F and second nozzles 11*a* arranged at a second nozzle interval (Pn2) narrower than the nozzle interval (Pn0) of the nozzles 11*b* arranged at the central part of the head 1 in the first direction F.

Further, two nozzle arrays 12 of the plurality of nozzle arrays 12 adjacent to each other in the first direction F include the nozzles 11*c* and 11*d* arranged at a constant nozzle interval (Pn1) in the first direction F.

FIG. 1 illustrates a nozzle position of the nozzle 11 by a solid line when the discharged droplet lands on a target landing position without causing a swerve of the discharged droplet. Further, FIG. 1 illustrates a nozzle position of the nozzle 11 by a broken line when the nozzle position of the nozzle 11 is corrected so that an actual landing position of the discharged droplet approaches the target landing position when the swerve of the discharged droplet is occurred.

In FIG. 1, the liquid discharged from the nozzle 11*a* of the nozzle array 12B is assumed to swerve in a direction away from the nozzle array 12A with respect to the target landing position. In FIG. 1, the liquid discharged from the nozzle 11*b* of the nozzle array 12B is assumed not to swerve from the target landing position. In FIG. 1, the liquid discharged from the nozzles 11*c* and 11*d* of the nozzle array 12B is assumed to swerve in a direction approaching the nozzle array 12A with respect to the target landing position.

Thus, the nozzle 11*a* of the nozzle array 12B is shifted to approach the nozzle 11*a* of the nozzle array 12A in the first direction F to reduce an amount of deviation between the target landing position and the actual landing position of the discharge droplets. The nozzles 11 before shifting are indicated by circles with a solid line, and the nozzles 11 after the shifting are indicated by circles with a broken line in FIG. 1. Further, the nozzles 11*c* and 11*d* of the nozzle array 12B are shifted away from the nozzles 11*c* and 11*d* of the nozzle array 12A in the first direction F. As described above, the nozzles 11 before the shifting are indicated by circles with a solid line, and the nozzles 11 after the shifting are indicated by circles with a broken line in FIG. 1. Thus, an amount of deviation between the target landing position of the discharged droplet and the actual landing position decreases.

Thus, each of the nozzles 11*a* to 11*d* in the nozzle array 12A and 12B includes the nozzles 11*a* having a nozzle interval of Pn2, the nozzle 11*b* having a nozzle interval of Pn0, and the nozzles 11*c* and 11*d* having a nozzle interval of Pn1.

That is, at least one nozzle array 12 of the plurality of nozzle arrays 12 (nozzle arrays 12 constituting the stage 13) includes at least two nozzles 11 arranged to have at least two different nozzle intervals (at least two of Pn0, Pn1, and Pn2).

Thus, the head 1 includes the nozzles 11 arranged so that the actual landing position of the nozzle approaches the target landing position according to a direction of swerve of the discharged droplets in the first direction F instead of uniformly widening or narrowing the nozzle interval Pn between the adjacent nozzle arrays 12 with respect to the target nozzle interval Pn0. Thus, the head 1 according to the present disclosure changes a nozzle interval to increase an accuracy of the landing position of the liquid droplet on a medium 410 (see FIG. 31).

Specific example of changing the nozzle interval is described below.

Figure 2:
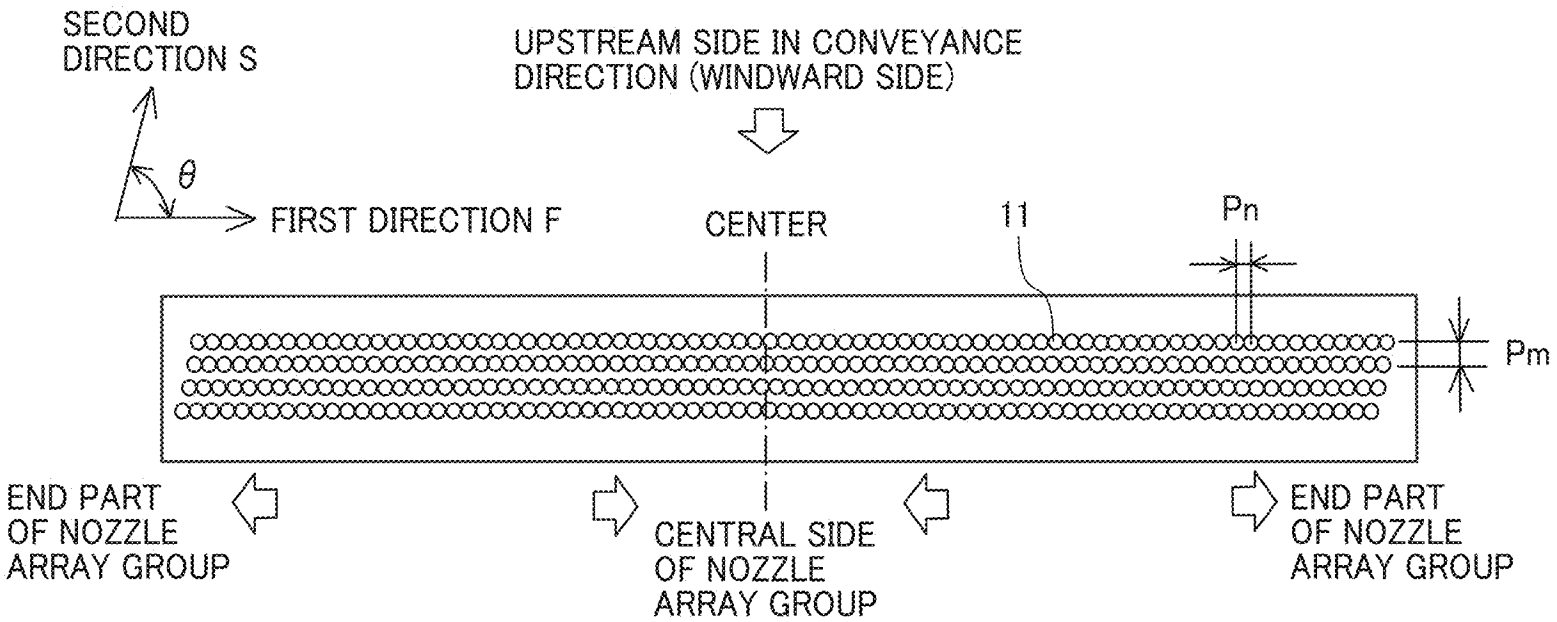
FIG. 2 is a plan view of a portion of the nozzle arrangement of the liquid discharge head illustrated.

FIG. 2 is a plan view of a nozzle arrangement of the head 1. In FIG. 2, a center of an arrangement of the nozzles 11 forming the stage 13 is referred to as "central side (part) of nozzle array group", and both ends of the arrangement of the nozzles 11 are referred to as "end part (side) of nozzle array group" in the first direction F. Further, a direction of conveyance of the medium 410 onto which the liquid (discharged droplets) is discharged from the head 1 is indicated by a vertical arrow directed downward in FIG. 2. Hereinafter, "the direction of conveyance of the medium" is simply referred to as "the medium conveyance direction". The stage 13D among four stages 13A to 13D (see FIG. 1) of the head 1 is arranged most windward side (upstream side) in the medium conveyance direction.

The head 1 has a total nozzle number of 320 nozzles. The nozzle interval Pm of the head 1 is 300 nozzles/inch in a direction perpendicular to the first direction F. A preset nozzle interval Pn0 of the head 1 is 75 nozzles/inch in the first direction F.

Figure 3:
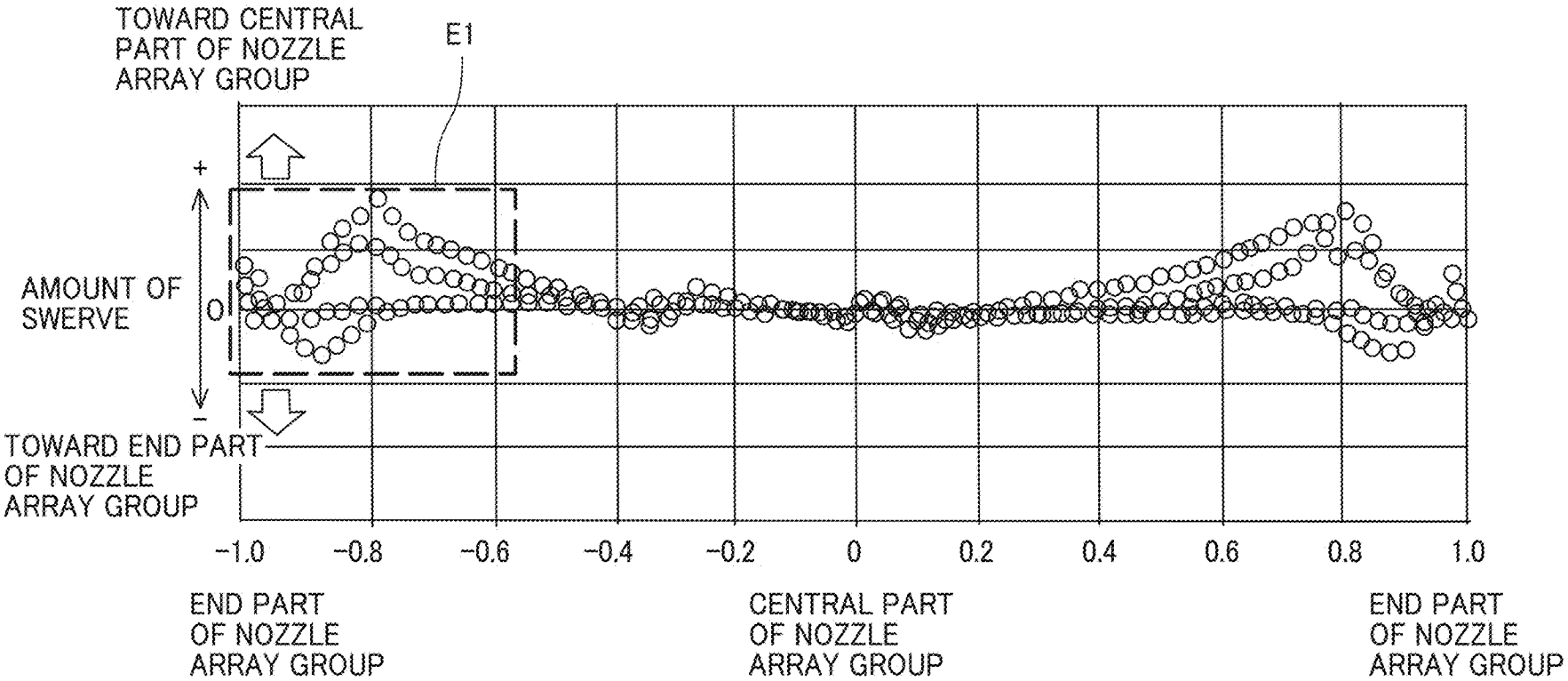
FIG. 3 is a graph illustrating a first example of a deviation of the landing position of the discharged droplets (amount and direction of swerve) in the first direction F when the liquid discharge head includes the nozzle array arranged at a constant nozzle interval Pn.
Figure 4:
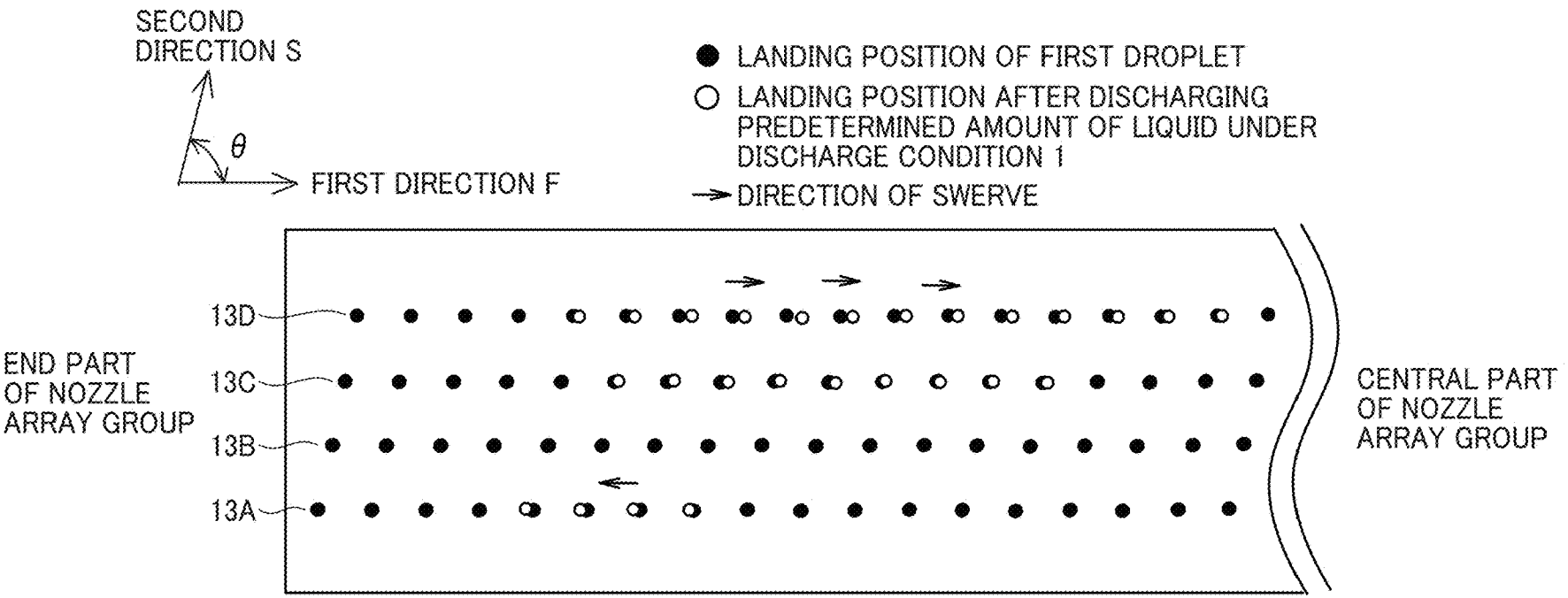
FIG. 4 is a schematic plan view of a portion of the nozzle arrangement of the liquid discharge head illustrating the deviation of the landing position of the discharged droplets (amount and direction of swerve) in the first direction F.

FIGS. 3 and 4 illustrate a first example of a deviation of the landing position of the discharged droplets in the first direction F when the head 1 includes the nozzle array 12 arranged at a constant nozzle interval Pn, for example, an equal interval such as the preset nozzle interval Pn0.

The first example in FIGS. 3 and 4 illustrates an amount of deviation (amount of swerve) and a direction of swerve of the landing position of the n-th droplet (n>1) in the first direction F after a predetermined numbers of droplets are discharged with respect to a landing position of a first droplet when a predetermined numbers of the droplets is discharged at a high frequency such as a solid image under a preset discharge condition 1, a conveyance speed of the medium 410 of which is set to T1.

In FIG. 3, a horizontal axis indicates a position of nozzle 11 in the first direction F, and a vertical axis indicates an amount of swerve and a direction of swerve of the discharged droplets. The direction of swerve is positive (+) when the discharged droplet is swerved toward the center part of the nozzle array group 14 and negative (−) when the discharged droplet is swerved toward the end part of the nozzle array group 14. Further, a central position of the nozzle array group 14 (stage 13) is set to "0", and positions at each ends of the nozzle array group 14 (stage 13) is set to "+1" and "−1", respectively in the position of nozzles in the first direction F in FIG. 3. As illustrated in FIG. 3, the swerve of the discharged droplets from the nozzle 11 disposed at a position around ±0.8 is large.

FIG. 4 is a plan view of a portion of the nozzle arrangement of the head 1 near the end E1 of the nozzle array group 14 of FIG. 3. In FIG. 4, a landing position of the first droplet is indicated by a black circle. Further, a landing position of the n-th (n>1) droplet after discharging the liquid for a predetermined amount under the discharge condition 1 from the nozzle 11 is indicated by a white circle. In FIG. 4, an amount of swerve of the discharged droplets from the nozzles 11 belonging to the stages 13C and 13D disposed upstream in the medium conveyance direction is large, and a direction of swerve is directed toward the center (inward direction) of the nozzle array group 14 under the discharge condition 1.

Figure 5:
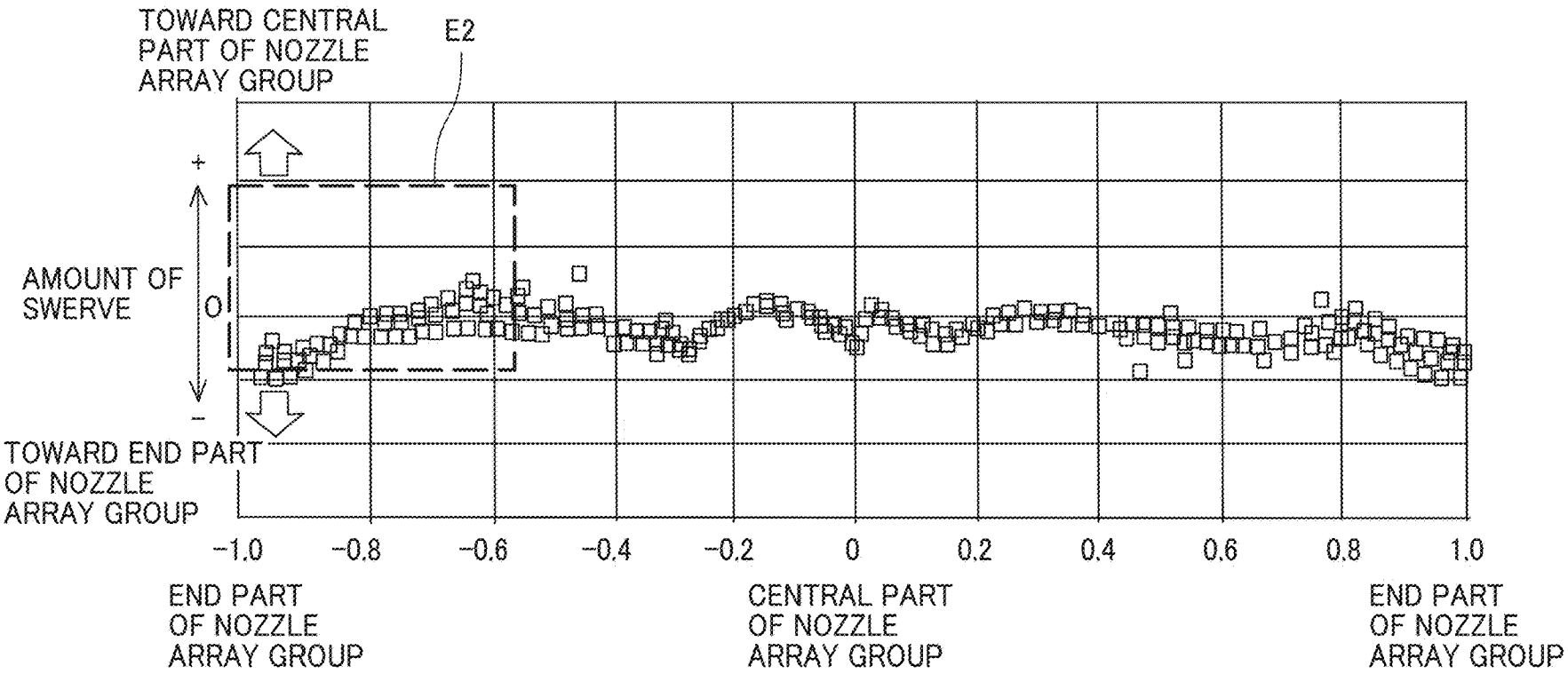
FIG. 5 is a graph illustrating a second example of a deviation of the landing position of the discharged droplets (amount and direction of swerve) in the first direction F when the liquid discharge head includes the nozzle array arranged at a constant nozzle interval Pn.
Figure 6:
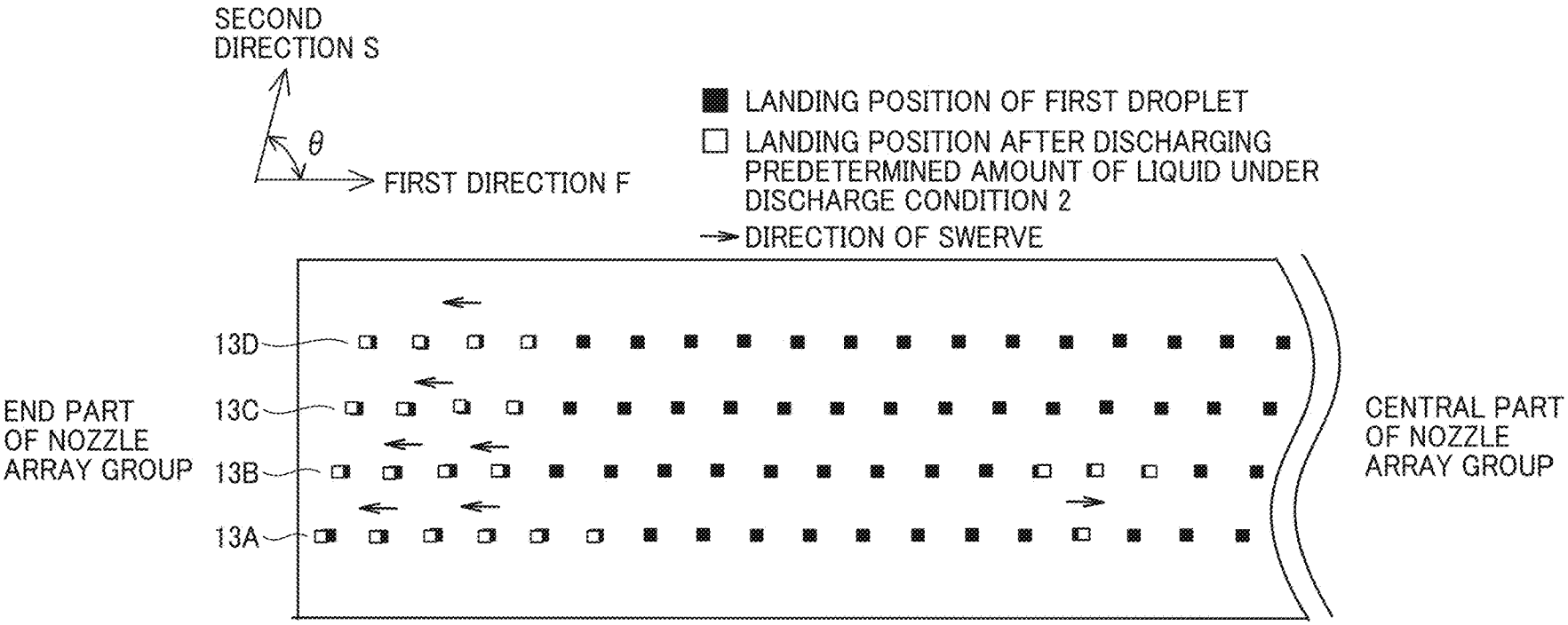
FIG. 6 is a schematic plan view of the portion of the nozzle arrangement of the liquid discharge head in the second example illustrating the deviation of the landing position of the discharged droplets (amount and direction of swerve) in the first direction F.

FIGS. 5 and 6 illustrate a second example of a deviation of the landing position of the discharged droplets in the first direction F when the head 1 includes the nozzle array 12 arranged at a constant nozzle interval Pn, for example, an equal interval such as the preset nozzle interval Pn0.

The second example in FIGS. 5 and 6 illustrates an amount of deviation (amount of swerve) and a direction of swerve of the landing position of the n-th droplet (n>1) in the first direction F after a predetermined numbers of droplets are discharged with respect to a landing position of a first droplet when a predetermined numbers of the droplets is discharged at a high frequency such as a solid image under a preset discharge condition 2. A conveyance speed T2 of the medium 410 under the discharge condition 2 is set to be higher than the conveyance speed T1 of the medium 410 under the discharge condition 1.

In FIG. 5, a horizontal axis indicates a position of nozzle 11 in the first direction F, and a vertical axis indicates an amount of swerve and a direction of swerve of the discharged droplets. The direction of swerve is positive (+) when the discharged droplet is swerved toward the center part of the nozzle array group 14 (stage 13) and negative (−) when the discharged droplet is swerved toward the end part of the nozzle array group 14. Further, a central position of the nozzle array group 14 (stage 14) is set to "0", and positions at each ends of the nozzle array group 14 (stage 13)

is set to "+1" and "−1", respectively in the position of nozzles in the first direction F in FIG. 3. As illustrated in FIG. 5, the swerve of the discharged droplets from the nozzle 11 disposed at a position around ±1.0 is large.

FIG. 6 is a plan view of a portion of the nozzle arrangement of the head 1 near the end E2 of the nozzle array group 14 of FIG. 5. In FIG. 6, a landing position of the first droplet is indicated by a black square. Further, a landing position of the n-th (n>1) droplet after discharging the liquid for a predetermined amount under the discharge condition 2 from the nozzle 11 is indicated by a white square. In FIG. 6, an amount of swerve of the discharged droplets from the nozzles 11 belonging to the stages 13A and 13B disposed downstream in the medium conveyance direction is large, and a direction of swerve is directed toward the end part (outward direction) of the nozzle array group 14 under the discharge condition 2.

As in the first and second examples described above, with discharge of a predetermined numbers of droplets, the landing position of the discharged droplet is shifted in the first direction. An interval (distance) between landing droplets discharged from the adjacent nozzles 11 in the first direction F becomes wider or narrower than a target distance. Hereinafter, "the landing droplets discharged from the adjacent nozzles 11" is simply referred to as "landing droplets of adjacent nozzles 11".

Widening of the interval between the landing droplets of adjacent nozzles 11 causes a white streaks with increase in the interval between the landing droplets, and narrowing of the interval between the landing droplets of adjacent nozzles 11 causes a black streak with decrease in the interval between the landing droplets. The white streaks and black streaks cause an abnormal image.

Figure 7:
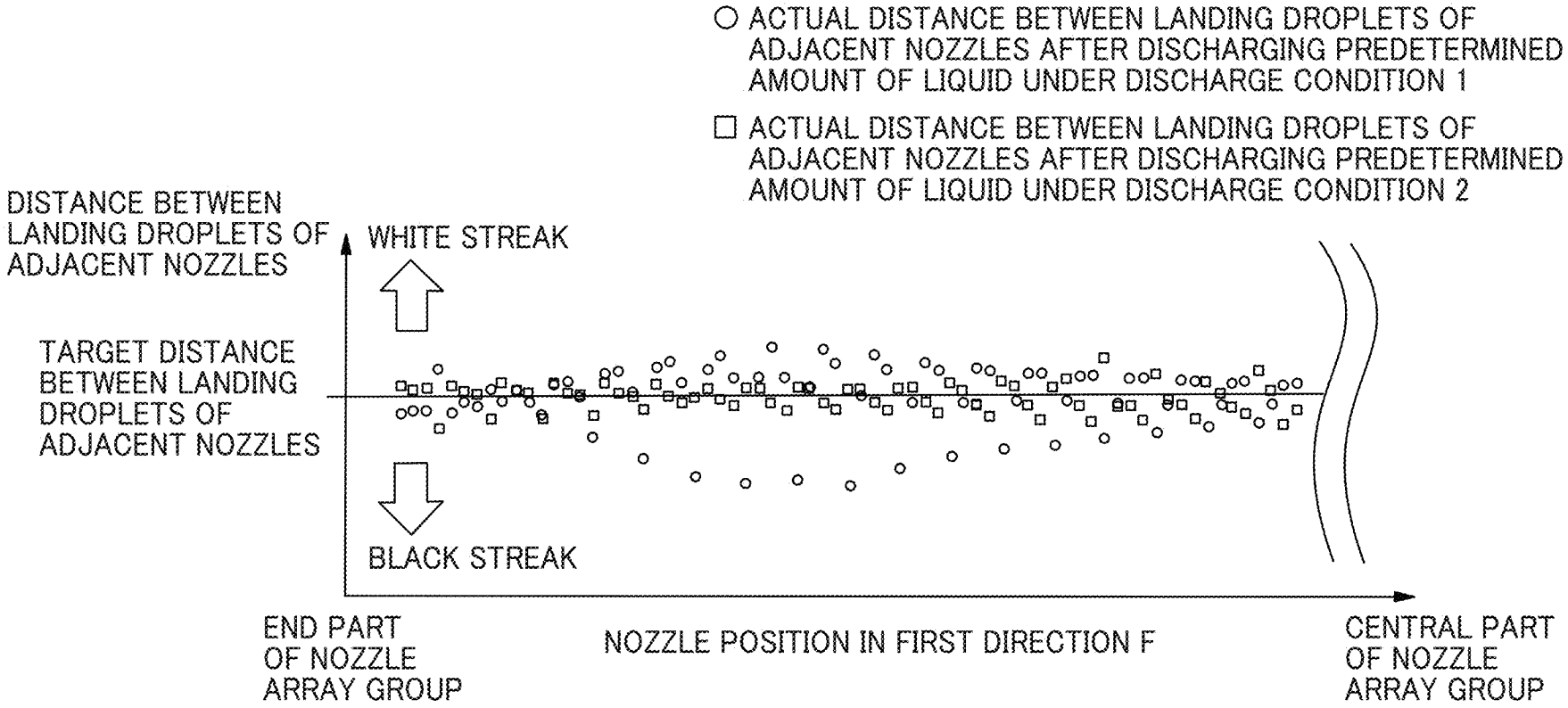
FIG. 7 is a graph illustrating a distance between adjacent landing droplets in the first example and the second example.

FIG. 7 illustrates an example of the interval (distance) between the landing droplets of adjacent nozzles 11 after a predetermined number of droplets is discharged under the discharge conditions 1 and 2 from the nozzles 11 of the nozzle arrays 12 adjacent in the first direction F. A horizontal axis in FIG. 7 indicates the nozzle position in the first direction F, and a vertical axis indicates a distance between the landing droplets of adjacent nozzles 11 in the first direction F. When the actual distance between the landing droplets of adjacent nozzles 11 is wider (larger) than a target distance between the landing droplets of adjacent nozzles 11, the actual distance is indicated in a region above the horizontal axis. The "target distance between the landing droplets of adjacent nozzles 11" is indicated by a horizontal line 150 illustrated above the horizontal axis in FIG. 7. The actual distance larger (wider) than the target distance indicated above the horizontal line 150 causes the white streaks in the image. When the actual distance between the landing droplets of adjacent nozzles 11 is smaller (narrower) than the target distance, the distance is indicated in a region below the horizontal line 150. The actual distance smaller (narrower) than the target distance indicated above the horizontal line 150 causes the black streaks in the image. As illustrated in FIG. 7, there are places in which the landing positions of adjacent nozzles 11 become wider or narrower in the positions of the nozzles 11 in the first direction F (in the horizontal axis in FIG. 7). Thus, the positions of the nozzles 11 (nozzle position) in the first direction F are corrected to reduce the deviation of an actual interval (distance) between the landing droplets of adjacent nozzles 11 from the target interval (distance) between the landing droplets of adjacent nozzles 11.

Figure 8:
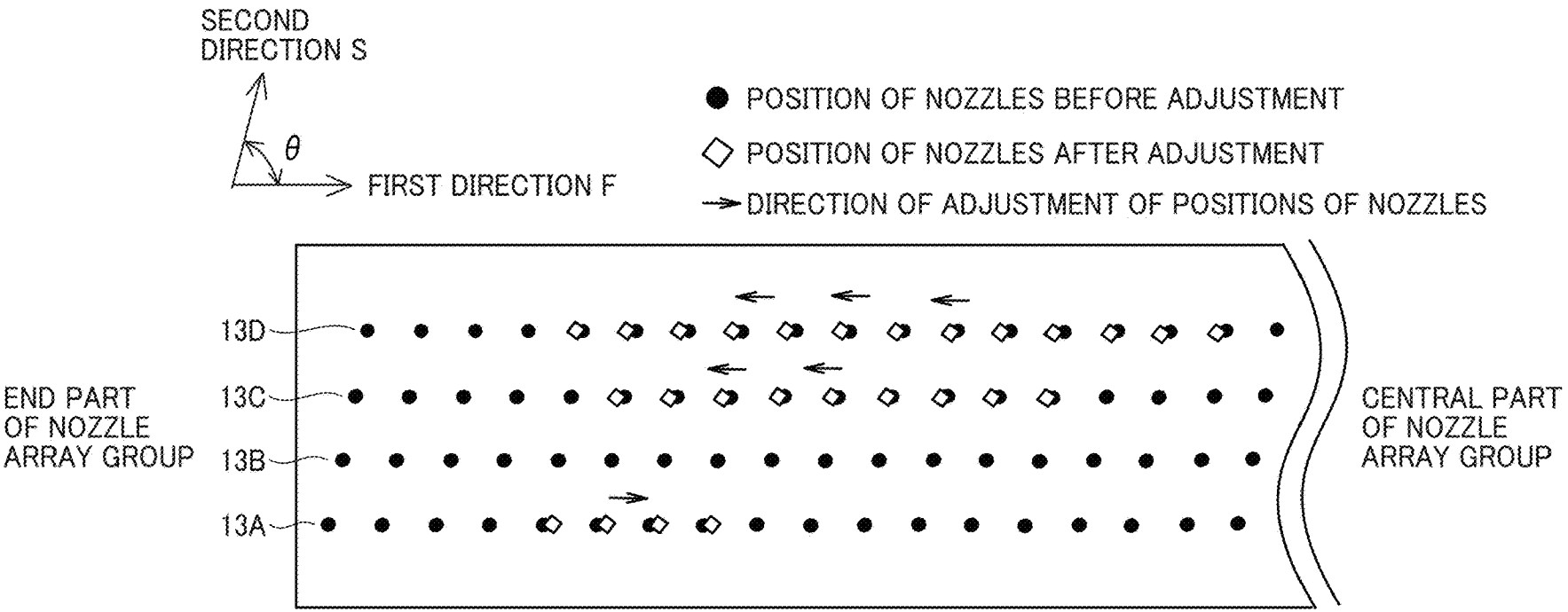
FIG. 8 is a plan view of the portion of the nozzle arrangement of the liquid discharge head illustrating a first correction.

FIG. 8 illustrates an example of a first correction of positions of the nozzles 11 when there is variation in the interval (distance) between the landing droplets of adjacent nozzles 11 as illustrated in FIG. 7.

In the example of the first correction example in FIG. 8, the position of the nozzle 11 before correction is indicated by a black circle, and the position of the nozzle 11 after correction is indicated by a white rhombus at the end part in the nozzle array group 14 in the first direction F.

The position of the nozzles 11 before correction is the position when the nozzles 11 are arranged at the nozzle interval Pn0, and the actual landing position may deviate from the target landing position due to the swerve of the discharged droplets in the first direction F. The position of the nozzles 11 after correction is the position in which the amount of deviation is smaller than the amount of deviation between the actual landing position and the target landing position of the discharged droplets when the liquid droplet is discharged from the nozzle 11 disposed at the position before correction.

The position of nozzles 11 with the first correction reduces the amount of swerve in the first direction F with respect to the position of the nozzle 11 before correction under the discharge conditions 1 and 2 when the stage 13D is arranged on the upstream in the medium conveyance direction, the nozzle position after correction is set in the first direction F relative to the nozzle position before correction The first correction shifts the positions of a part of nozzles 11 in the stages 13C and 13D toward the end part of the nozzle array group 14 and shifts the positions of a part of nozzles 11 in the stage 13A toward the center part of the nozzle array group 14 as indicated by arrows in FIG. 8.

Shifting the position of the nozzle 11 (nozzle position) toward the center part of the nozzle array group 14 or toward the end part of the nozzle array group 14 changes the nozzle interval Pn between the nozzles 11 of adjacent nozzle arrays 12 in the nozzles 11 constituting the nozzle array 12. Thus, a plurality of nozzles 11 in the nozzle array 12 includes pairs of the nozzles 11 arranged at least two different nozzle intervals Pn as illustrated in the nozzle intervals Pn0, Pn1, and Pn2 in FIG. 1.

Thus, as illustrated in FIG. 8, two nozzle arrays 12 of the plurality of nozzle arrays 12 are arranged at an end part of the head 1 in the first direction F. The two nozzle arrays 12 of the plurality of nozzle arrays 12 includes first nozzles 11*d* arranged at an upstream in the medium conveyance direction, the first nozzles 11*d* arranged at a first nozzle interval Pn1 wider than a nozzle interval Pn0 of the nozzles 11*b* arranged at a central part of the head 1 in the first direction F, and second nozzles 11*a* arranged at a downstream of the first nozzles 11*d* in the medium conveyance direction, the second nozzles 11*a* arranged at a second nozzle interval Pn2 narrower than a nozzle interval Pn0 of the nozzles 11*b* arranged at the central part of the head 1 in the first direction F.

A number of the plurality of nozzle arrays 12 including the first nozzles 11*d* is larger than a number of the plurality of nozzle arrays 12 including the second nozzles 11*a* as illustrated in FIG. 8.

Figure 9:
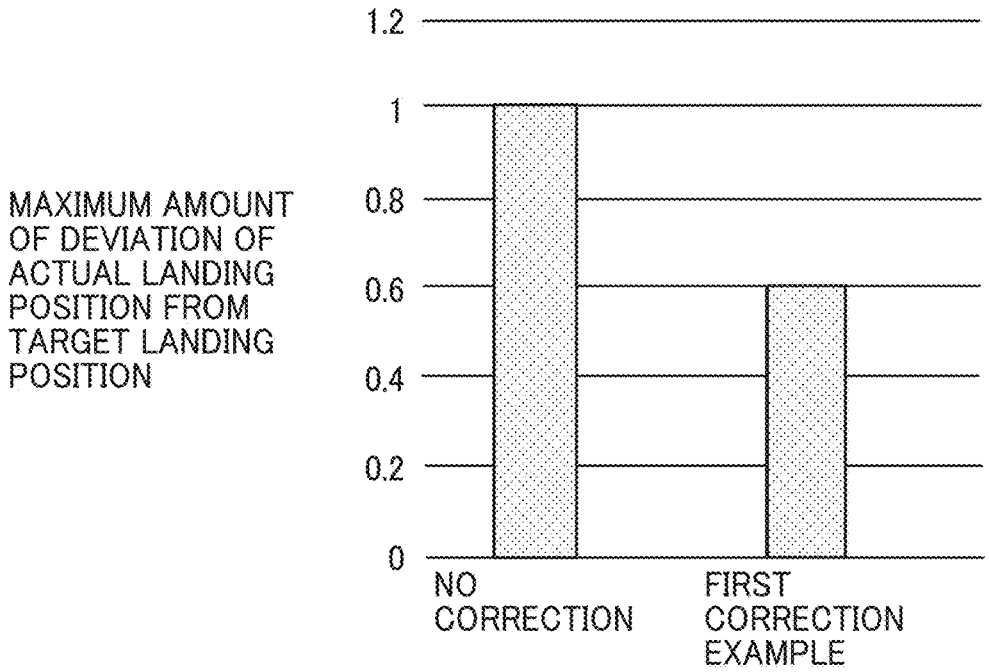
FIG. 9 is a graph illustrating a maximum amount of deviation of the actual landing position from the target landing position in the first direction F in the first correction.
Figure 10:
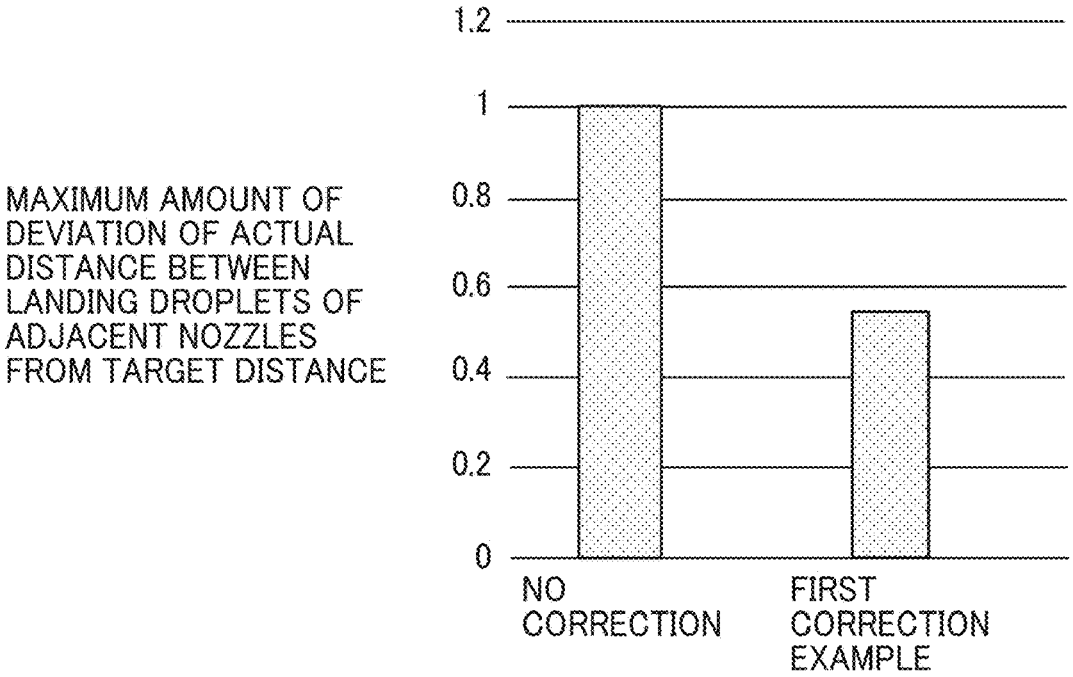
FIG. 10 is a graph illustrating a maximum amount of deviation of an actual distance between the landing droplets of adjacent nozzles from a target distance between the landing droplets of adjacent nozzles 11 in the first direction F in the first correction.

FIG. 9 is a graph illustrating a maximum amount of deviation of the actual landing position from the target landing position in the first direction F in the first correction. FIG. 10 is a graph illustrating a maximum amount of deviation of an actual distance between the landing droplets of adjacent nozzles 11 from the target distance between the landing droplets of adjacent nozzles 11 in the first direction F in the first correction.

Here, the maximum amount of deviation of the actual landing position from the target landing position is the maximum amount of deviation in the amount of deviation of the actual landing position from the target landing position in the nozzle array group 14. Further, the maximum amount of deviation of distance is the maximum amount of deviation of actual distance between the landing droplets of adjacent nozzles 11 from the target distance. Thus, with decrease in the maximum amount of deviation of the actual landing position from the target landing position, the amount of deviation of the actual landing position from the target landing position decreases in FIG. 9. Thus, with decrease in the maximum amount of deviation of the actual distance between the landing droplets of adjacent nozzles 11 from the target distance, the white streaks and the black streaks becomes incognizable.

The nozzle position is corrected for the nozzles 11 disposed at the nozzle position of ±0.5 or more (near the end part of the nozzle array group 14) in FIGS. 3 and 5 described above. The position of the nozzles 11 may be corrected regardless of the nozzle position of the nozzles 11. However, a sufficient effect can be obtained by correcting only the nozzle position of the nozzles 11 in the vicinity of a region having a large amount of deviation in the landing position since the maximum amount of deviation in the landing position is affected by the nozzle 11 having a large amount of deviation in the landing position.

From the results illustrated in FIGS. 9 and 10, the nozzle position of the nozzles 11 is corrected to be shifted toward a direction opposite to the direction of swerve in the first direction F. Thus, the head 1 can reduce both of the maximum amount of deviation of the actual landing position from the target landing position and the maximum amount of deviation of the actual distance between the landing droplets of adjacent nozzles 11 from the target distance. Thus, the deviation in the landing position of the discharged droplet becomes incognizable as an image abnormality even if the landing position is deviated.

Figure 11:
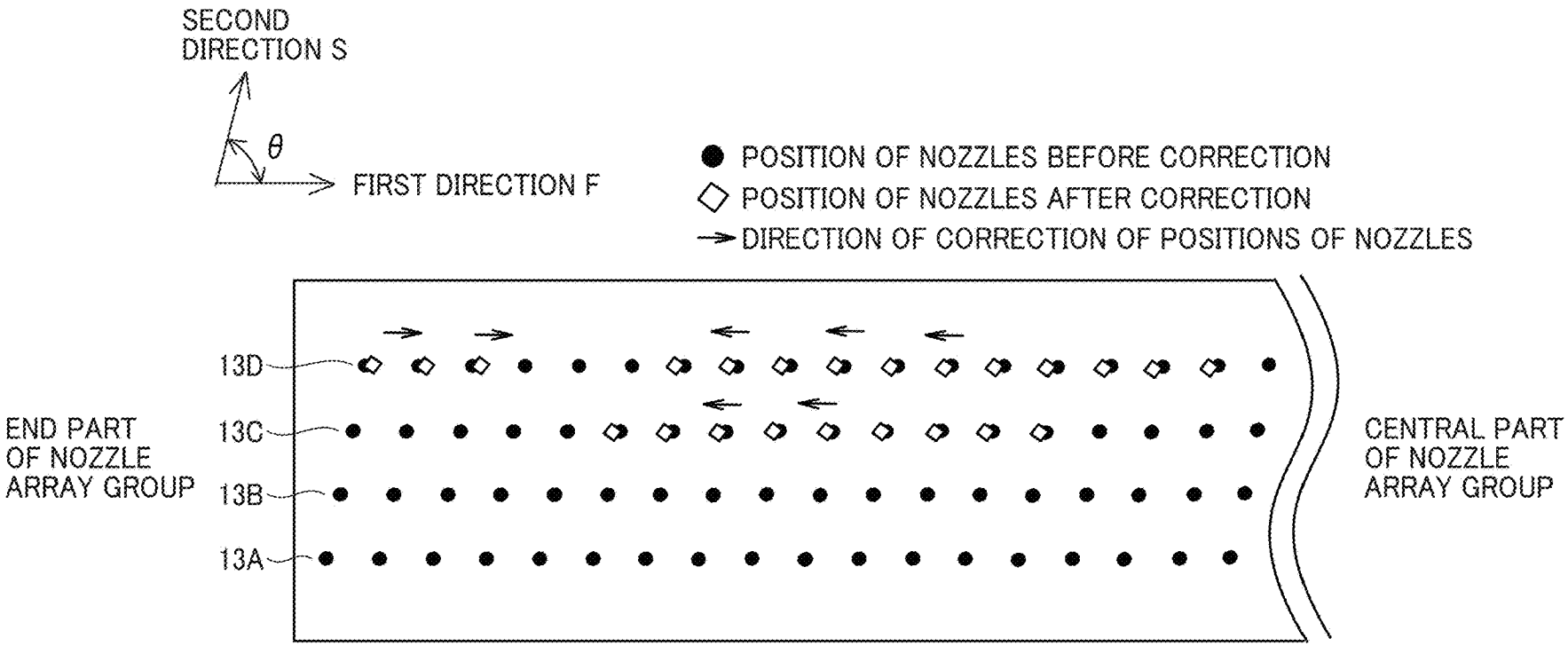
FIG. 11 is a plan view of the portion of the nozzle arrangement of the liquid discharge head illustrating a second correction.

FIG. 11 is a plan view of the arrangement of the nozzles 11 illustrating an example of a second correction of the nozzle position having variation in the distance (interval) of landing droplets of adjacent nozzles 11 as illustrated in FIG. 7.

The second correction corrects the nozzle position of the nozzles 11 in the stage 13C so that the second correction shifts the positions of part of the nozzles 11 arranged at an end part of the nozzle array group 14 in the stage 13C toward the central part of the nozzle array group 14 in the first direction F. The second correction further shifts the positions of part of the nozzles 11 arranged at a central part of the nozzle array group 14 toward the end part of the nozzle array group 14 in the first direction F. Further, the second correction shifts the positions of part of nozzles 11 arranged at central part of the nozzle array group 14 in the stage 13C toward the end part of the nozzle array group 14 in the first direction F.

Shifting the position of the nozzle 11 (nozzle position) toward the central part of the nozzle array group 14 or toward the end part of the nozzle array group 14 changes the nozzle interval Pn between adjacent nozzles 11 in adjacent nozzle arrays 12 in the first direction F in the nozzles 11 that configures the nozzle array 12. Thus, a plurality of nozzles 11 in the nozzle array 12 includes pairs of the nozzles 11 arranged at least two different nozzle intervals Pn as illustrated in the nozzle intervals Pn0, Pn1, and Pn2 in FIG. 1.

Figure 12:
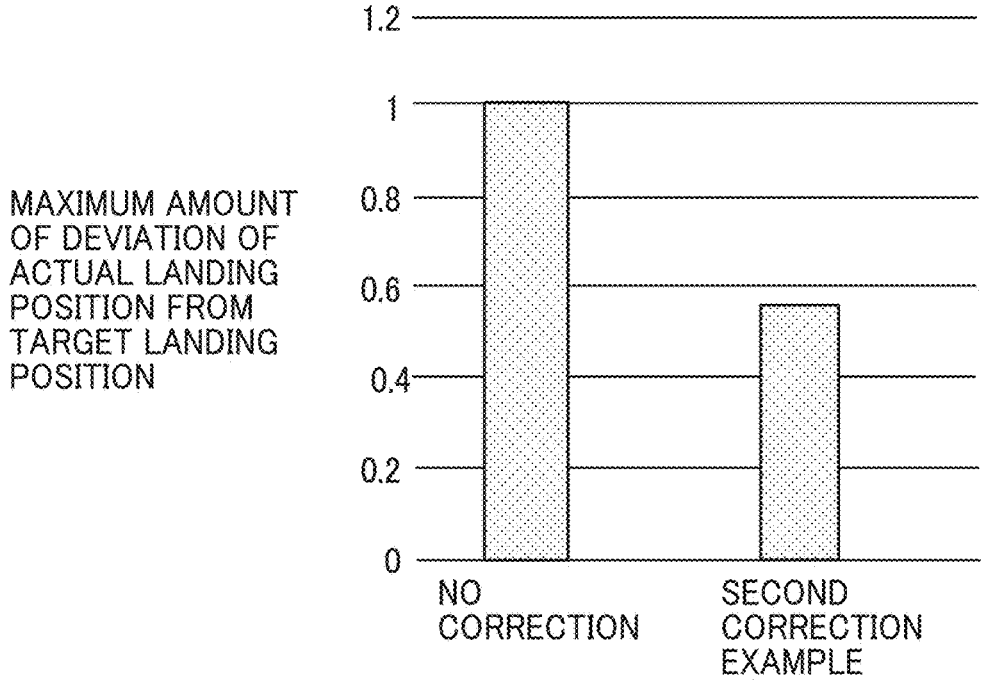
FIG. 12 is a graph illustrating a maximum amount of deviation of the actual landing position from the target landing position in the first direction F in the second correction.
Figure 13:
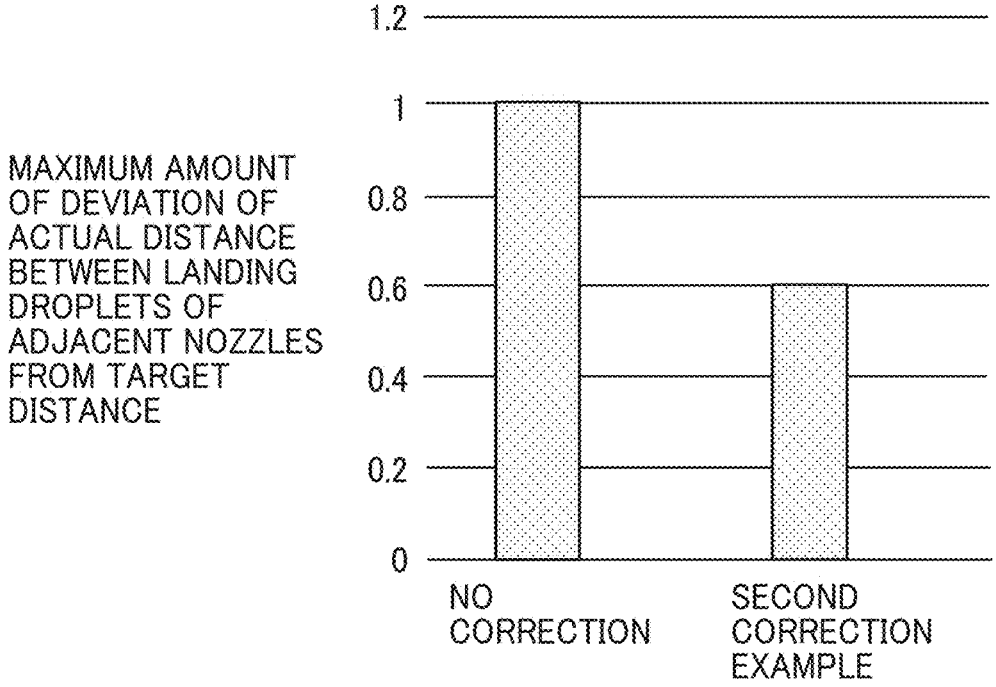
FIG. 13 is a graph illustrating a maximum amount of deviation of an actual distance between the landing droplets of adjacent nozzles from a target distance between the landing droplets of adjacent nozzles in the first direction F in the second correction.

The stage 13D of the head 1 in the second correction is disposed upstream in the medium conveyance direction under the discharge condition 1. FIGS. 12 and 13 respectively illustrate the results of the maximum amount of deviation of the actual landing position from the target landing position in the first direction F and the maximum amount of deviation of the actual distance from the target distance in the first direction F when the stage 13 of the head 1 is disposed upstream in the medium conveyance direction under the discharge condition 2.

Thus, as illustrated in FIG. 11, the nozzles 11 disposed at the same stage 13D in the second direction S in each of the plurality of nozzle arrays 12 arranged in the first direction F includes first nozzles 11 arranged at an upstream in the medium conveyance direction, the first nozzles 11 arranged at a first nozzle interval Pn1 wider than a nozzle interval Pn0 of the nozzles 11 in the plurality of nozzle arrays 12 arranged at a central part of the head 1 in the first direction F, and second nozzles 11 arranged at a downstream in the medium conveyance direction of the first nozzles 11, the second nozzles 11 arranged at a second nozzle interval Pn2 narrower than a nozzle interval Pn0 of the nozzles 11 in the plurality of nozzle arrays 12 arranged at the central part of the head 1 in the first direction F.

A number of the plurality of nozzle arrays 12 including the first nozzles 11 is larger than a number of the plurality of nozzle arrays 12 including the second nozzles 11.

As illustrated in FIGS. 12 and 13, the second correction corrects the nozzle positions to reduce the maximum amount of deviation of the landing position and the maximum amount of deviation of the distance to be smaller than the maximum amount of deviation of the landing position and the maximum amount of deviation of the distance, respectively, when the nozzle positions of the nozzles 11 are not corrected. Thus, the head 1 according to the present disclosure can reduce the deviation of the landing position to the extent that the deviation is not recognized as an image abnormality even if the deviation in the landing position occurs.

The above-described examples of the first and second corrections may specify and correct the nozzles 11 disposed upstream in the medium conveyance direction (such as stages 13C and 13D) during discharge operation of the liquid droplet. The first and second corrections may correct the nozzle position of the nozzles 11 so that amount of correction of the nozzle position becomes substantially identical when the nozzle array group 14 is viewed from each sides in a direction perpendicular to the first direction (in the medium conveyance direction). Thus, the first and second corrections may correct the nozzle position of the nozzles 11 so that arrangement of the interval (distance) of the nozzles 11 becomes identical when the nozzle array group 14 is viewed from each sides in a direction perpendicular to the first direction (in the medium conveyance direction).

The above-described correction can obtain the same effect even when any side of the stage 13 of the nozzle array 12 is arranged on the upstream in the medium conveyance direction. Thus, the above-described correction can obtain the same effect regardless of the direction of printing when the head 1 is used in a serial-type printing apparatus.

Figure 14:
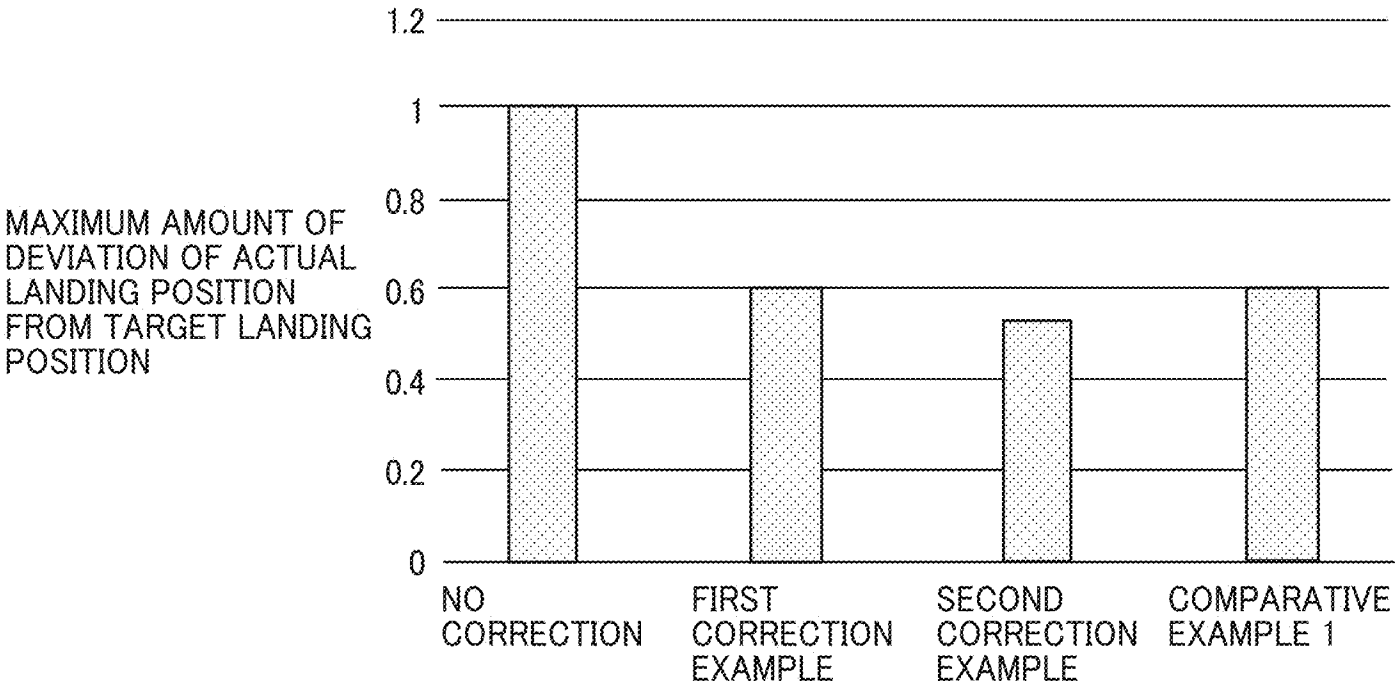
FIG. 14 is a graph illustrating a maximum amount of deviation of the actual landing position from the target landing position in the first direction F in the first correction, second correction, and a comparative example 1.
Figure 15:
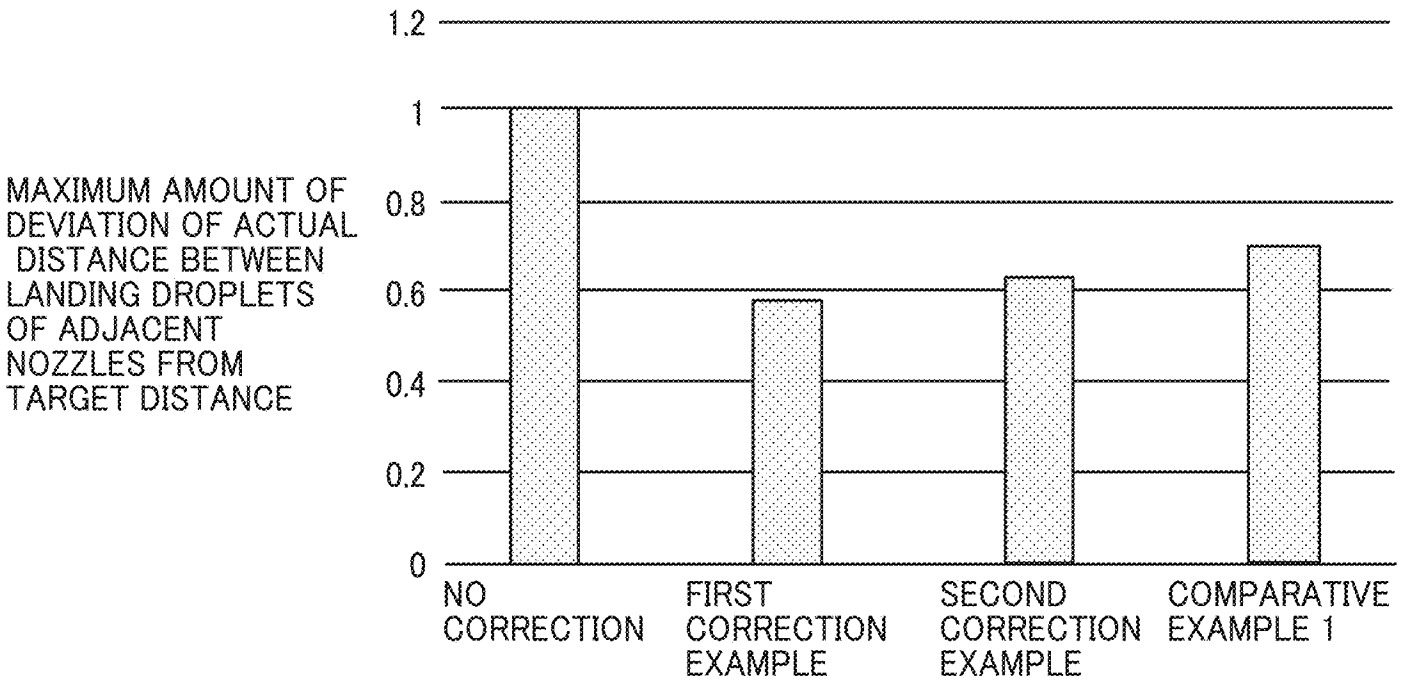
FIG. 15 is a graph illustrating a maximum amount of deviation of the actual distance between the landing droplets of adjacent nozzles from the target distance between the landing droplets of adjacent nozzles in the first direction F in the first correction, second correction, and the comparative example 1.

In a head 1 of a Comparative Example 1, an interval (distance) of nozzles 11 arranged at the end part of the nozzle array group 14 in the first direction F is larger (wider) than an interval (distance) of nozzles 11 arranged at the central part of the nozzle array group 14 in the first direction F. FIGS. 14 and 15 respectively illustrate the results of comparison of the maximum amount of deviation of the actual landing position from the target landing position in the first direction F and the maximum amount of deviation of the actual distance from the target distance in the first direction F among the heads 1 of no-correction, the first correction, the second correction, and the Comparative Example 1.

As illustrated in FIG. 14, the maximum amount of deviation of the landing position of the head 1 corrected by the second correction becomes smaller than the maximum amount of deviation of the landing position of the head 1 of the Comparative Example 1. Further, as illustrated in FIG. 15, each of the maximum amount of deviations of the distance of the head 1 corrected by the first and second corrections becomes smaller than the maximum amount of deviation of the distance of the head 1 of the Comparative Example 1.

In the first and second corrections, the swerve of the droplets discharged from the nozzles 11 disposed around ±0.8 (see FIG. 5) under the discharge condition 1 and from the nozzles 11 disposed around ±1.0 (see FIG. 5) under the discharge condition 2 becomes large. However, the positions of the nozzles 11 that cause the swerve varies according to the nozzle arrangement, the discharge conditions, and the like. Thus, the nozzle position is preferably corrected according to the nozzle arrangement or the like.

Figure 16:
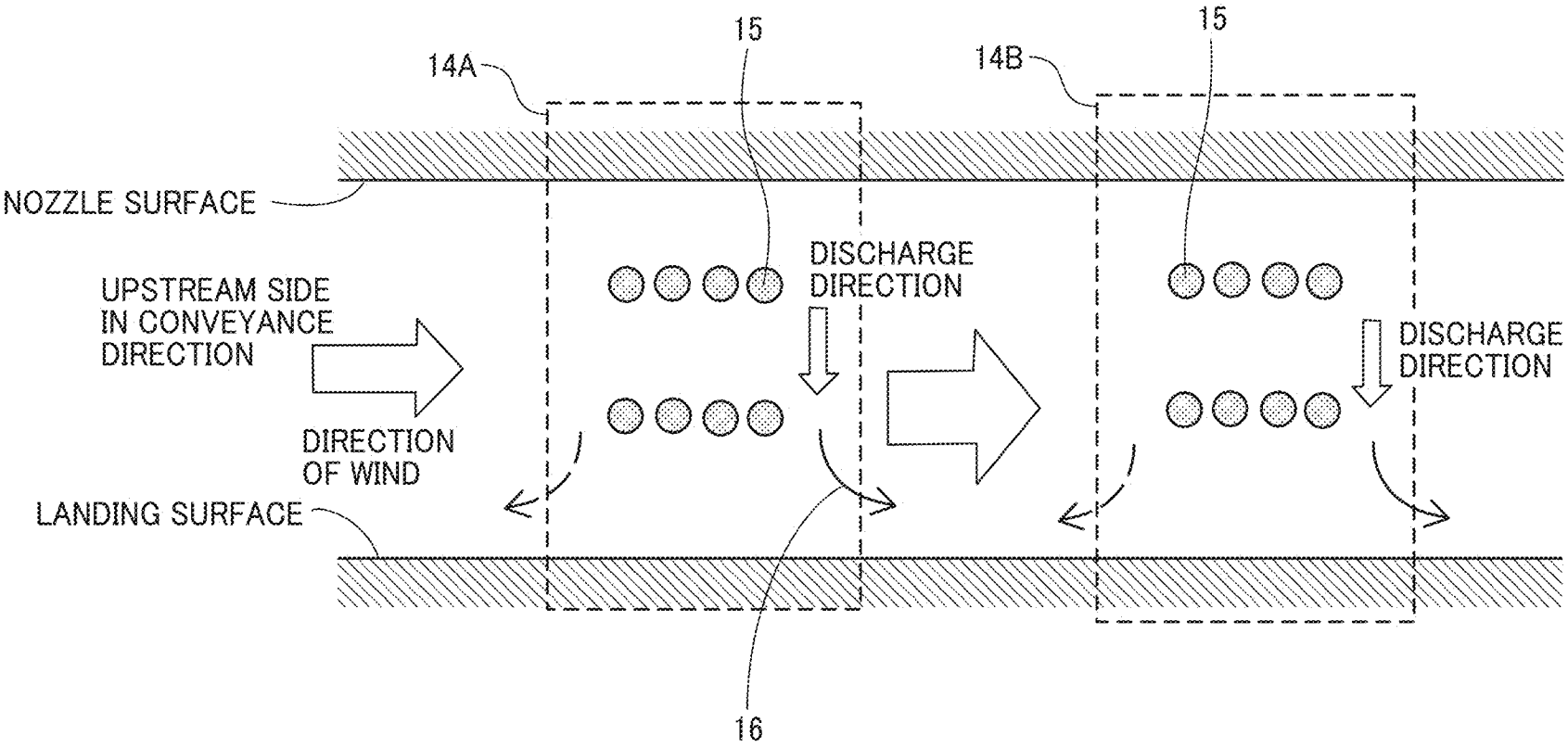
FIG. 16 is an enlarged plan view of a nozzle arrangement of a liquid discharge head according to a second embodiment of the present disclosure.

Next, a second embodiment of the present disclosure is described with reference to FIG. 16. FIG. 16 is an enlarged plan view of a nozzle arrangement of the head 1 according to the second embodiment of the present disclosure.

The head 1 in the second embodiment includes a plurality of, for example, two nozzle array groups 14A and 14B (see FIG. 23 described below). The nozzle array group 14A is arranged on the upstream in the medium conveyance direction, and the nozzle array group 14B is arranged on the downstream in the medium conveyance direction. A gap is provided between the nozzle array group 14A and the nozzle array group 14B in the medium conveyance direction.

In FIG. 16, an airflow generated by conveyance of the medium 410 in addition to an airflow 16 generated by droplets 15 discharged from the nozzles 11 influence the nozzle array group 14B disposed downstream in the medium conveyance direction.

The droplets 15 are discharged from the nozzle array group 14A disposed upstream of the nozzle array group 14B in the medium conveyance direction and generates airflow in the downstream in the medium conveyance direction. Thus, the discharge condition of the nozzle array group 14B is different from the discharge condition of the nozzle array group 14A such that a conveyance speed of the medium 410 at the nozzle array group 14B is higher than the conveyance speed of the medium 410 at the nozzle array group 14A. Thus, even if the nozzle array group 14A disposed upstream in the medium conveyance direction is in the discharge condition 1, the nozzle array group 14B disposed downstream in the medium conveyance direction is in the discharge condition 2.

Thus, the head 1 includes a plurality of nozzle array groups 14A and 14B each including the plurality of nozzle arrays 12. The nozzle intervals Pn of the nozzles 11 are different between the plurality of nozzle array groups 14A and 14B.

Thus, the head 1 according to the second embodiment corrects the nozzle position according to the amount and direction of swerve of the discharged droplets. Thus, the head 1 according to the second embodiment can improve the accuracy of the landing position as compared to the Comparative Example 1. The Comparative Example 1 has a configuration in which the nozzle interval (distance) between the nozzles 11 located at both ends of the nozzle array group 14 in the first direction F is set to be uniformly wider than the nozzle interval (distance) between the nozzles 11 located at the central part of the nozzle array group 14.

Figure 17:
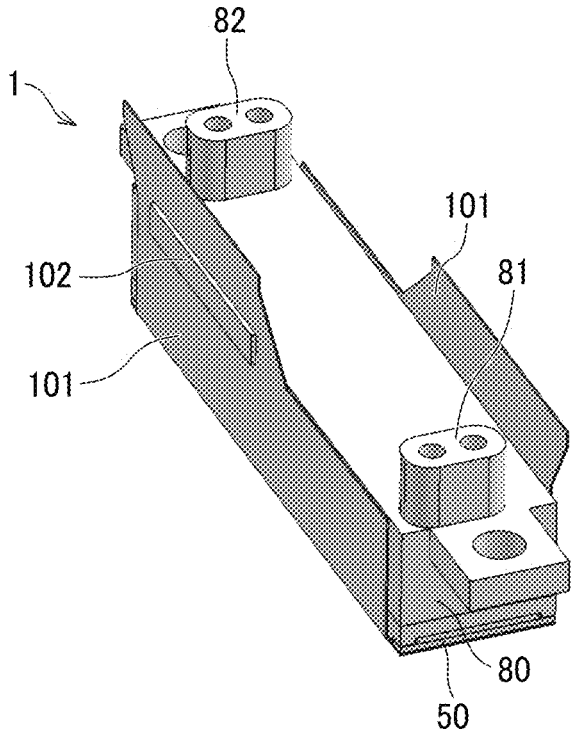
FIG. 17 is an external perspective view of a liquid discharge head according to a third embodiment of the present disclosure.
Figure 18:
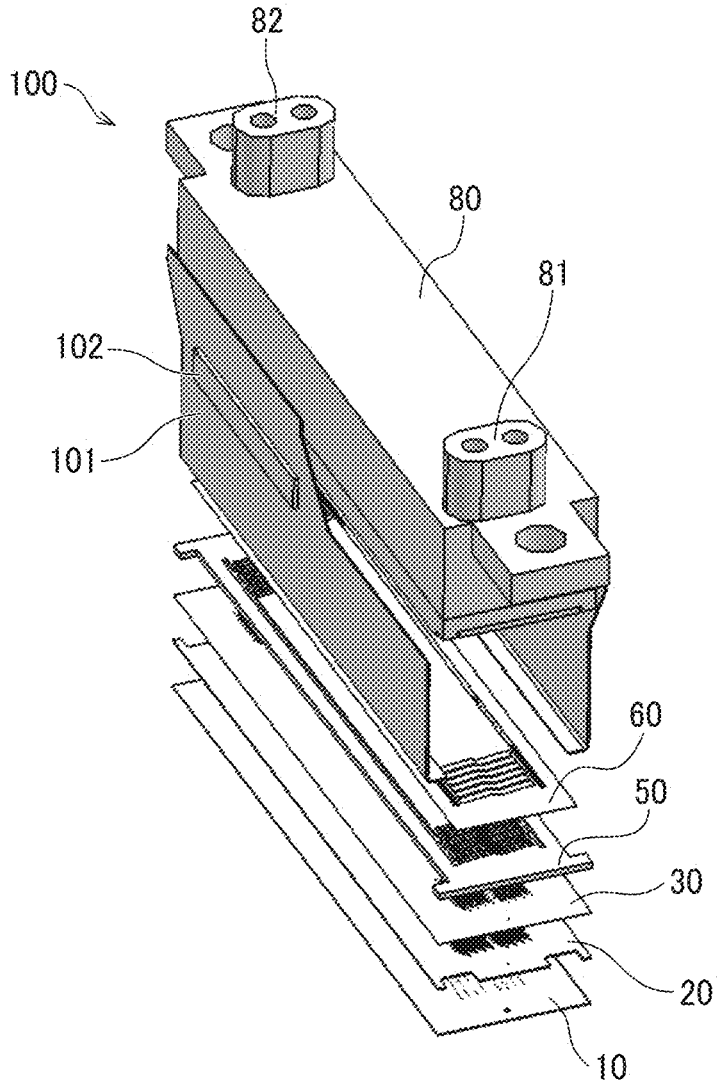
FIG. 18 is an exploded perspective view of the liquid discharge head in the third embodiment.
Figure 19:
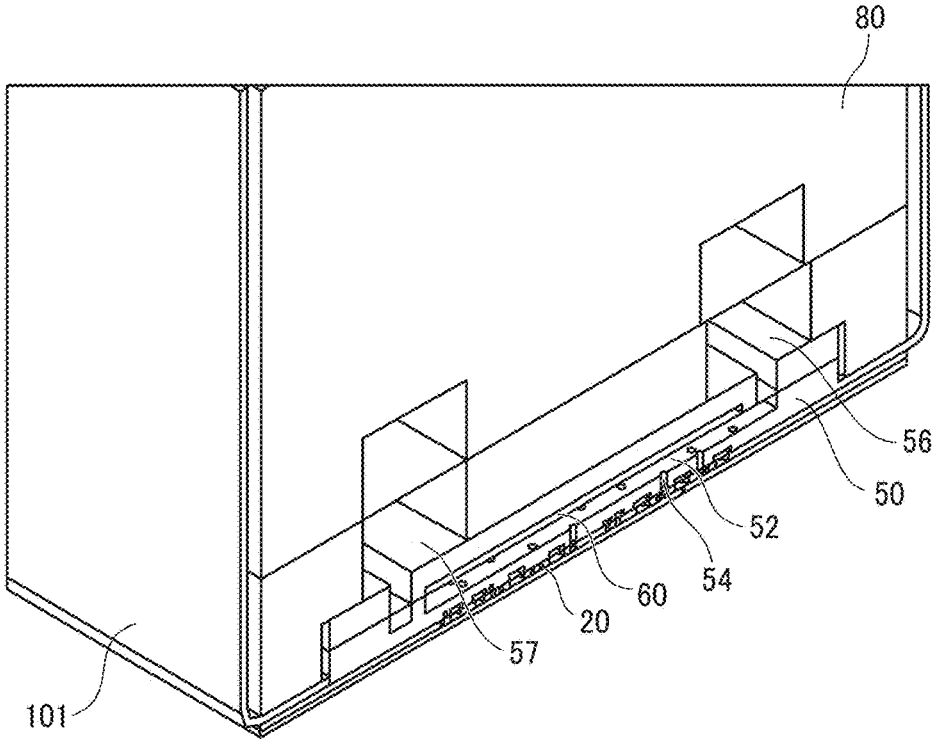
FIG. 19 is an explanatory cross-sectional perspective view of the liquid discharge head in the third embodiment.
Figure 20:
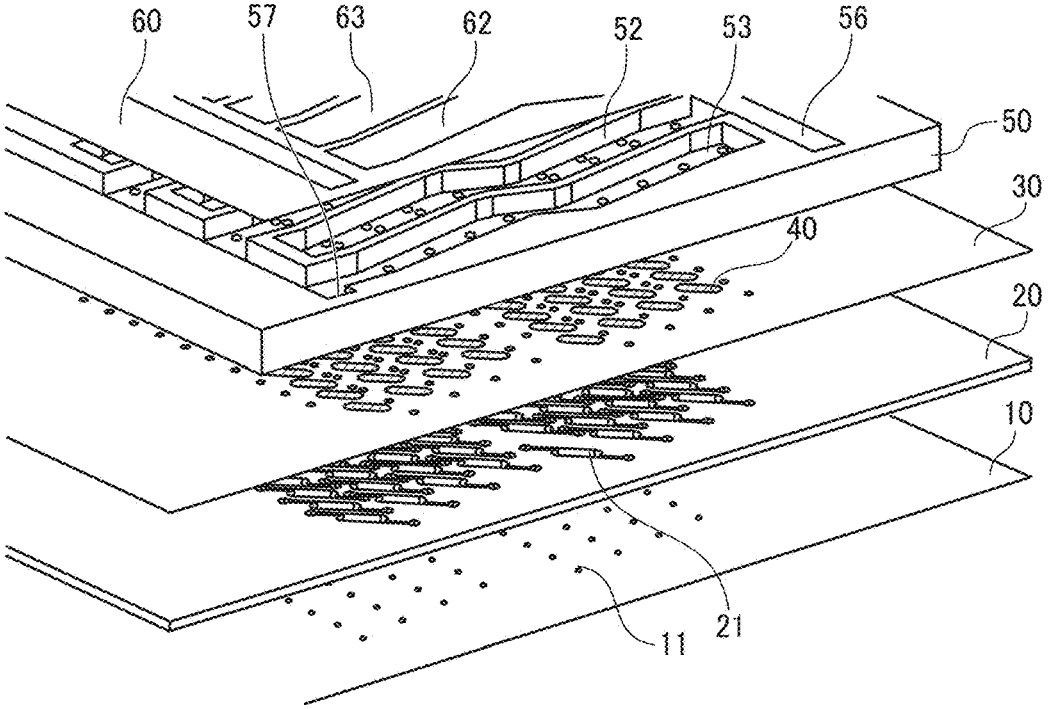
FIG. 20 is an exploded perspective view of the liquid discharge head without a frame in the third embodiment.
Figure 21:
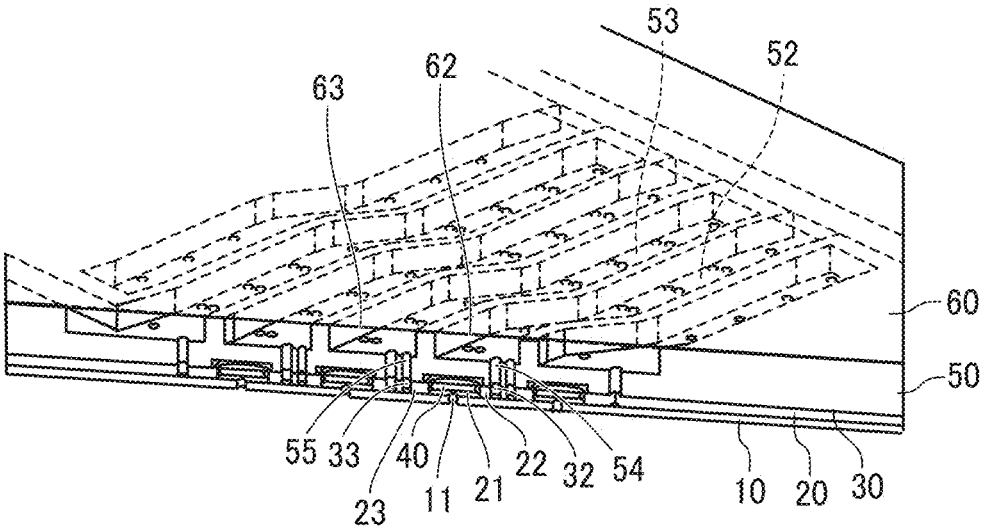
FIG. 21 is a cross-sectional perspective view of channels in the liquid discharge head in the third embodiment.
Figure 22:
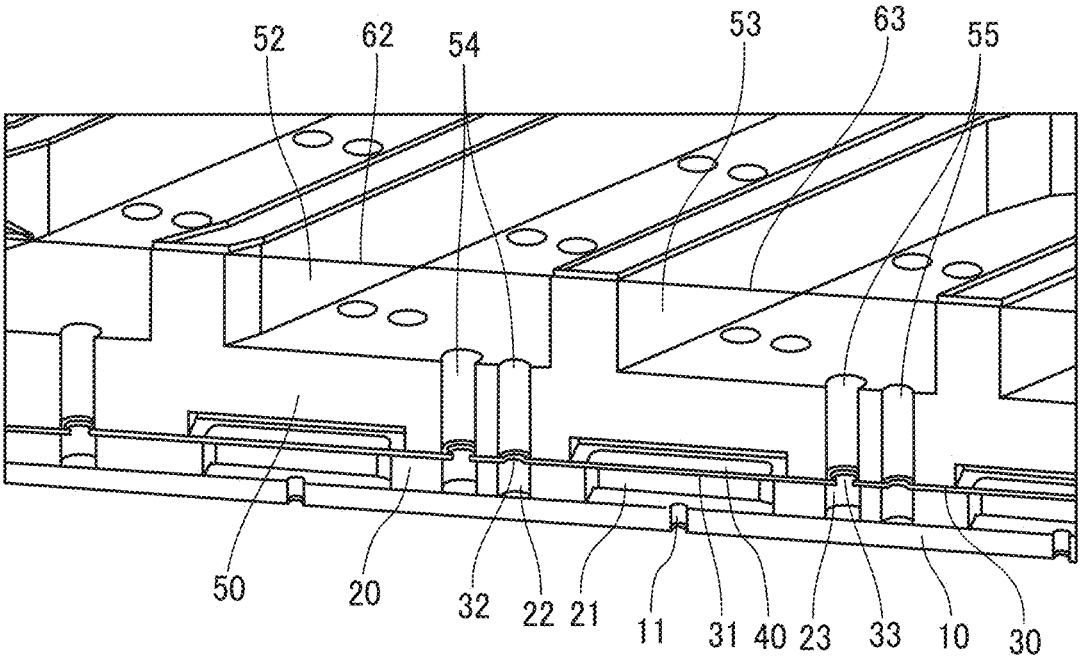
FIG. 22 is an enlarged cross-sectional perspective view of the channels in the third embodiment.

Next, a third embodiment of the present disclosure is described with reference to FIGS. 17 to 23. FIG. 17 is an outer perspective view of the head 1 according to the third embodiment. FIG. 18 is an exploded perspective view of the head 1. FIG. 19 is a cross-sectional perspective view of the head 1. FIG. 20 is an exploded perspective view of the head 1 excluding a frame. FIG. 21 is a cross-sectional perspective view of channels of the head 1. FIG. 22 is an enlarged cross-sectional perspective view of the channels of the head 1. FIG. 23 is a plan view of the channels of the head 1.

The liquid discharge head 1 includes a nozzle plate 10, a channel plate (individual channel member 20), a diaphragm member 30, a common channel member 50, a damper 60, a frame 80, and a substrate 101 mounting a drive circuit 102 (flexible wiring substrate).

The nozzle plate 10 includes a plurality of nozzles 11 to discharge liquid. As illustrated in FIG. 23, the plurality of nozzles 11 are arranged two-dimensionally in a matrix and are arranged side by side in three directions of a first direction F, a second direction S and a third direction T.

The individual channel member 20 includes a plurality of pressure chambers 21 (individual chambers) respectively communicating with the plurality of nozzles 11, a plurality of individual supply channels 22 respectively communicating with the plurality of pressure chambers 21, and a plurality of individual collection channels 23 respectively communicating with the plurality of pressure chambers 21. A combination of one pressure chamber 21, one individual supply channel 22 communicating with one pressure chamber 21, and one individual collection channel 23 communicating with one pressure chamber 21 is collectively referred to as an individual channel 25.

The diaphragm member 30 forms a diaphragm 31 serving as a deformable wall of the pressure chamber 21, and the piezoelectric element 40 is formed on the diaphragm 31 to form a single body. Further, a supply-side opening 32 communicating with the individual supply channel 22 and a collection-side opening 33 communicating with the individual collection channel 23 are formed on the diaphragm member 30. The piezoelectric element 40 is a pressure generator to deform the diaphragm 31 to pressurize the liquid in the pressure chamber 21.

Note that the individual channel member 20 and the diaphragm member 30 are not limited to be separate members. For example, an identical member such as a Silicon on Insulator (SOI) substrate may be used to form the individual channel member 20 and the diaphragm member 30 in a single body. That is, an SOI substrate formed by sequentially forming a silicon oxide film, a silicon layer, and a silicon oxide film on a silicon substrate is used.

The SOI substrate on the silicon substrate forms the individual channel member 20, and the silicon oxide film, the silicon layer, and the silicon oxide film in the SOI substrate form the diaphragm 31. In the above-described configuration, the layer structure of the silicon oxide film, the silicon layer, and the silicon oxide film in the SOI substrate forms the diaphragm member 30. As described above, the diaphragm member 30 includes a member made of the material that is film-formed on a surface of the individual channel member 20.

The common channel member 50 includes a plurality of common-supply branch channel 52 communicating with two or more individual supply channels 22 and a plurality of common-collection branch channel 53 communicating with two or more individual collection channels 23. The plurality of common-supply branch channel 52 and the plurality of common-collection branch channel 53 are alternately formed adjacent to each other in the second direction S of the nozzle 11 (see FIG. 23).

As illustrated in FIG. 22, the common channel member 50 includes a through hole serving as a supply port 54 that connects the supply-side opening 32 of the individual supply channel 22 and the common-supply branch channel 52 and a through hole serving as a collection port 55 that connects the collection-side opening 33 of the individual collection channel 23 and the common-collection branch channel 53.

Further, as illustrated in FIGS. 19 to 23, the common channel member 50 includes one or more common-supply main channel 56 communicating with the plurality of common-supply branch channels 52 and one or more common-collection main channel 57 communicating with the plurality of common-collection branch channels 53.

The damper 60 includes a supply-side damper 62 that faces (opposes) the supply port 54 of the common-supply branch channel 52 and a collection-side damper 63 that faces (opposes) the collection port 55 of the common-collection branch channel 53.

As illustrated in FIGS. 20 to 22, the common-supply branch channel 52 and the common-collection branch channel 53 are formed by sealing grooves with the supply-side damper 62 or the collection-side damper 63 of the damper 60. The grooves are alternately arranged in the common channel member 50 in which both of the common-supply branch channel 52 and the common-collection branch channel 53 are formed. As a material of the damper 60, it is preferable to use a metal thin film or an inorganic thin film resistant to an organic solvent. A thickness of the supply-side damper 62 and the collection-side damper 63 of the damper 60 is preferably 10 μm or less.

Figure 24:
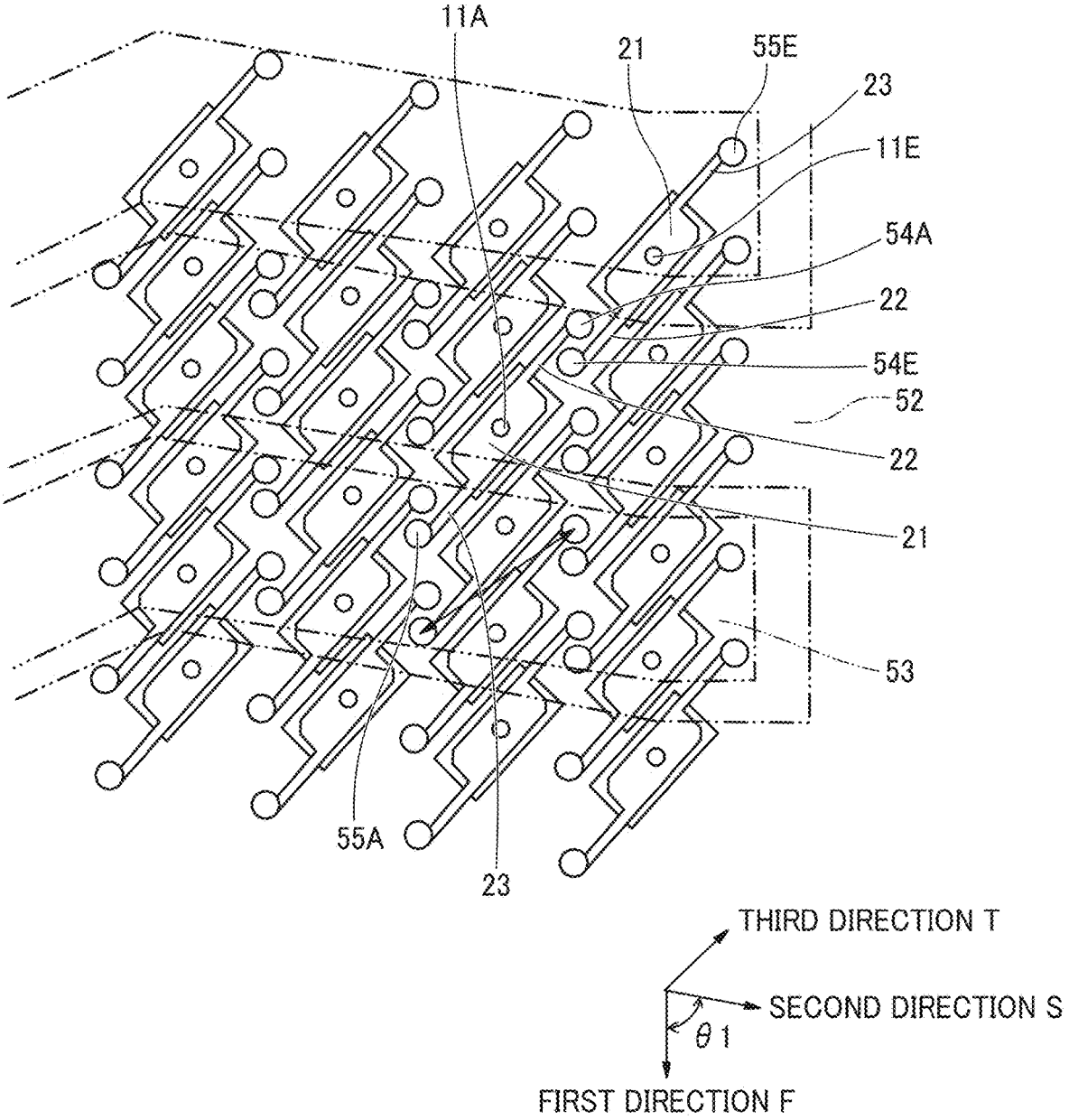
FIG. 24 is an enlarged plan view of a portion of the liquid discharge head in the third embodiment in FIG. 23.
Figure 25:
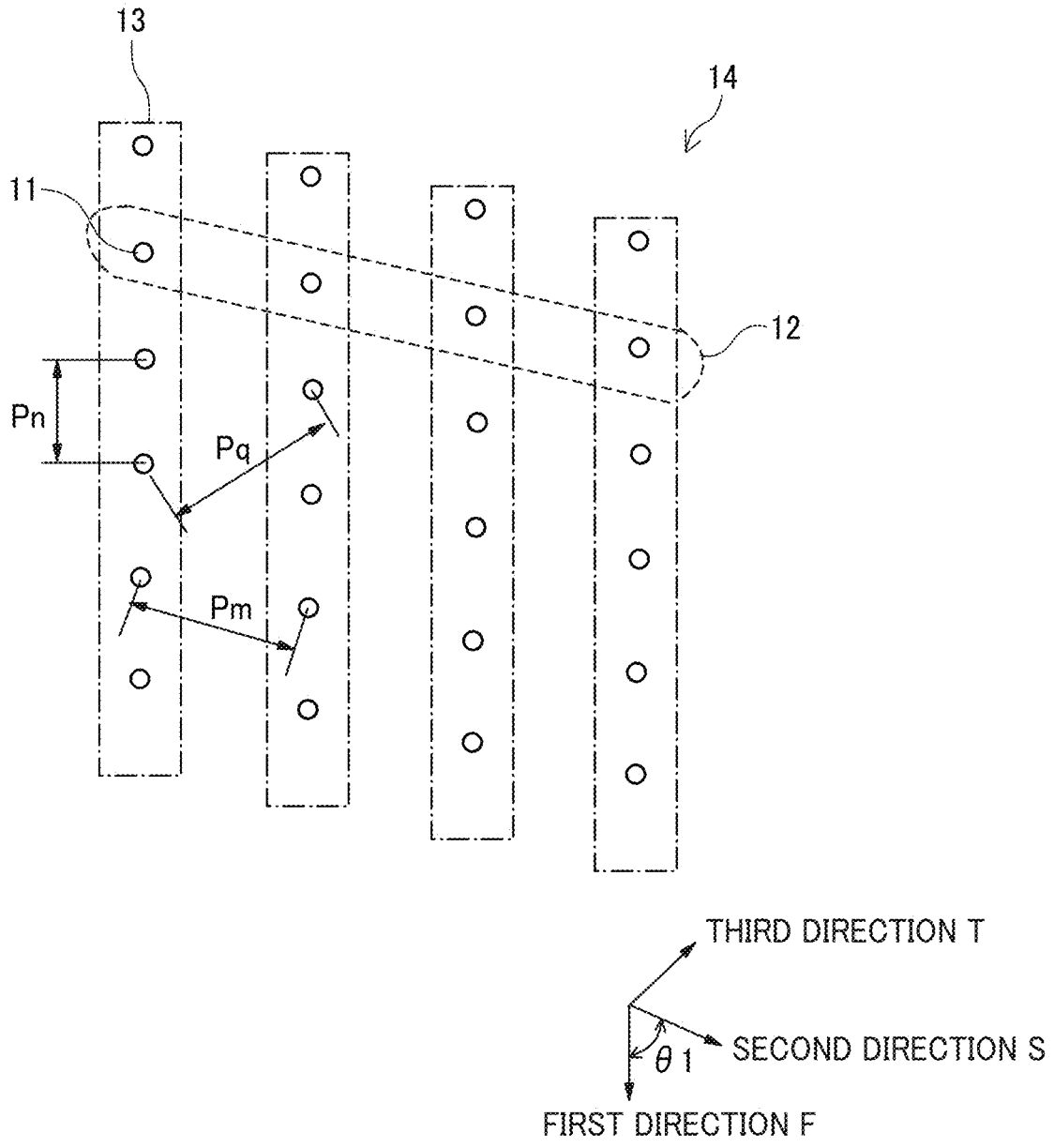
FIG. 25 is a plan view of a of the nozzle arrangement illustrated in 23.

Next, an arrangement of nozzles 11 and the channels in the present disclosure is described with reference also to FIGS. 23 to 25. FIG. 24 is an enlarged plan view of a portion of the head 1. FIG. 25 is a plan view of a of the nozzle arrangement illustrated in 23. In FIG. 24, branch channels such as the common-supply branch channels 52 and the common-collection branch channels 53 are indicated by imaginary lines.

Figure 23:
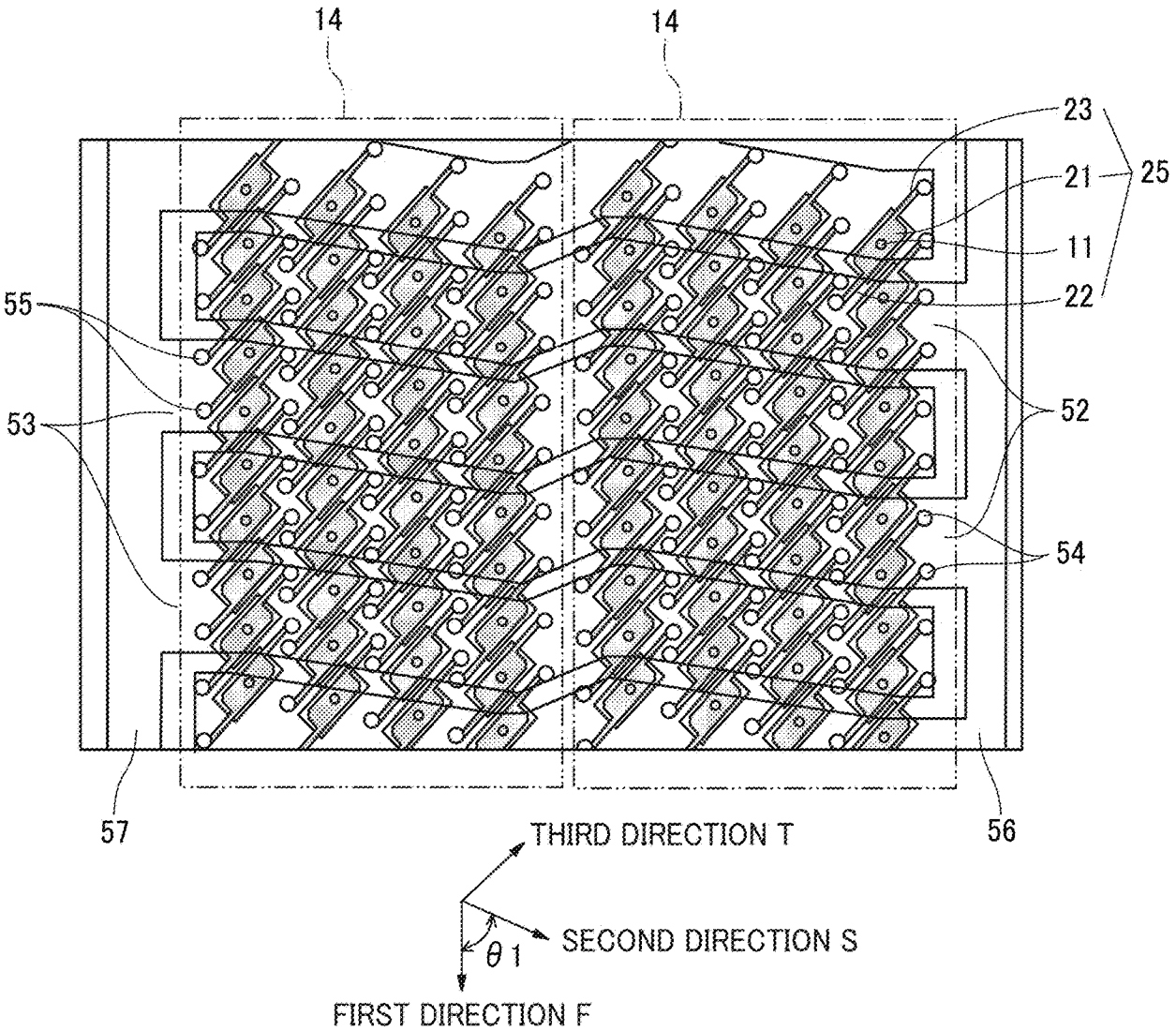
FIG. 23 is a plan view of the channels of the liquid discharge head in the third embodiment.

As illustrated in FIG. 23, the plurality of nozzles 11 are arranged two-dimensionally in a matrix and are arranged side by side in three directions of a first direction F, a second direction S and a third direction T. As illustrated in FIG. 23, a group of the nozzles 11 arranged two-dimensionally in a matrix is defined as a nozzle array group 14.

The head 1 has a plurality of nozzle arrays 12 in which a plurality of nozzles 11 are arrayed in a second direction S. The plurality of nozzle arrays 12 are arranged side by side in a first direction F that intersects the second direction S with a predetermined inclined degrees θ1 (see FIG. 23). The common-supply branch channel 52 and the common-collection branch channel 53 extend in the second direction S. Therefore, a longitudinal direction of the common-supply branch channel 52 and the common-collection branch channel 53 is along the second direction S.

In one nozzle array group 14, the first direction F is a direction (nozzle array direction) in which most adjacent nozzles 11 are arranged (arrayed) and is a direction intersecting the second direction S at an angle θ1 with respect to the second direction S. Thus, the common-supply branch channel 52 and the common-collection branch channel 53 are alternately arranged in the first direction F.

In one nozzle array group 14, the third direction T is a direction intersecting the first direction F and the second direction S. In the present disclosure, the individual channels 25 configured by the individual supply channel 22, the pressure chambers 21, and the individual collection channels 23 is arranged along the third direction T.

The individual channel 25 (see FIG. 23) configured by the individual supply channel 22, the pressure chamber 21, and the individual collection channel 23 has a shape of twice rotational symmetrical with an axis of the nozzle 11 (central axis in a direction of liquid discharge from the nozzle 11).

Thus, the head 1 in an example illustrated in FIG. 24 can be designed such that the individual channel 25 is arranged reversal to nozzles 11A and 11E adjacent in a direction (third direction T) parallel to a direction of liquid flow in the individual channel 25 as in a relation between the individual channel 25 communicating with the nozzle 11A and the individual channel 25 communicating with the nozzle 11E, for example.

The supply port 54A communicating with the individual channel 25 of the nozzle 11A and the supply port 54E communicating with the individual channel 25 of the nozzle 11E are arranged in the identical common-supply branch channel 52. Further, a direction of arrangement of the individual channel 25 communicating with the supply port 54A can be arranged opposite (reversal) to a direction of arrangement of the individual channel 25 communicating with the supply port 54E.

Thus, a package density of the individual channels 25 (nozzles 11) can be increased without being restricted by an arrangement of the common-supply branch channel 52, and the head thus can be downsized.

Further, in the example illustrated in FIG. 24, the nozzle 11A connected to the supply port 54A and the nozzle 11E connected to the supply port 54E communicate with different common-collection branch channels 53 through collection ports 55A and 55E, respectively. Thus, two nozzles 11 communicating with two supply ports 54 arranged nearest to each other (closest to each other) and arranged in the identical common-supply branch channel 52 communicate with different common-collection branch channels 53 via two collection ports 55, respectively.

The individual channels 25 are translationally symmetrical (not reversely arranged) in the second direction S along which the liquid flows in the common-supply branch channel 52 and the common-collection branch channel 53.

As illustrated in FIG. 25, an interval Pq between the nozzles 11 adjacent in the third direction T can be set in an arbitrary direction. However, the interval Pq can be set wider than an interval Pn between the nozzles 11 adjacent in the first direction F and an interval Pm between the nozzles 11 adjacent in the second direction S.

Thus, the head 1 in the third embodiment includes the nozzles 11, the nozzle interval Pn between the nozzles 11 in the adjacent nozzle arrays 12 of which is arranged so that the actual landing position of the discharged droplet approaches the target landing position according to a direction of swerve and an amount of swerve of the discharged droplet in the first direction F. Thus, the nozzle array 12 includes the nozzles 11 in the nozzle arrays 12 adjacently arranged in the first direction F and the nozzles 11 arranged at least two different nozzle intervals Pn.

Thus, the head 1 can improve accuracy of the landing position of the discharged droplets.

Figure 26:
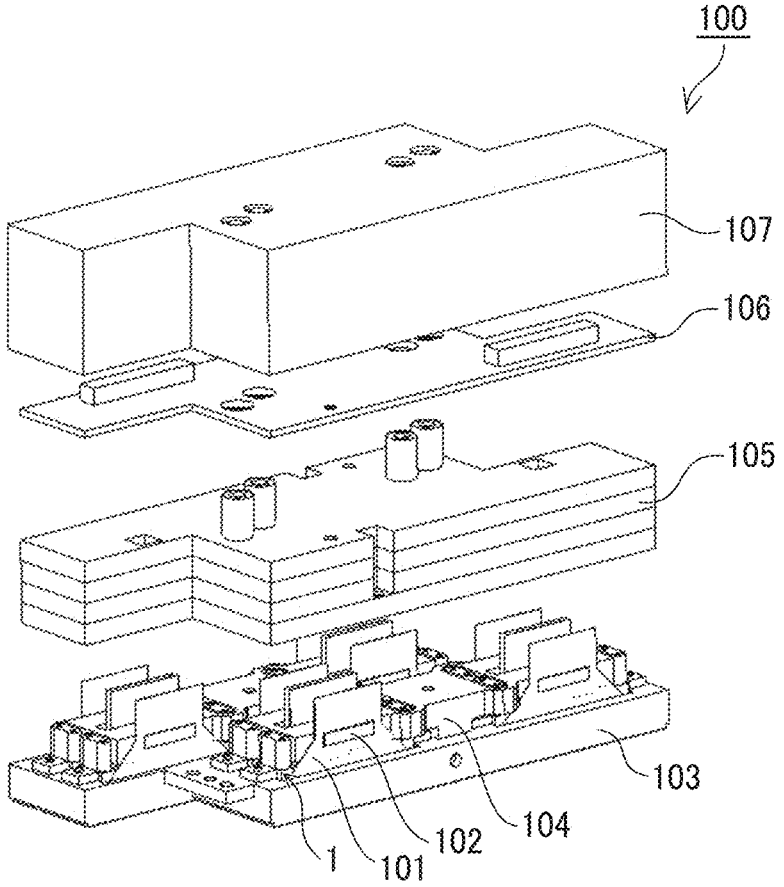
FIG. 26 is an exploded perspective view of a head module according to the present disclosure.
Figure 27:
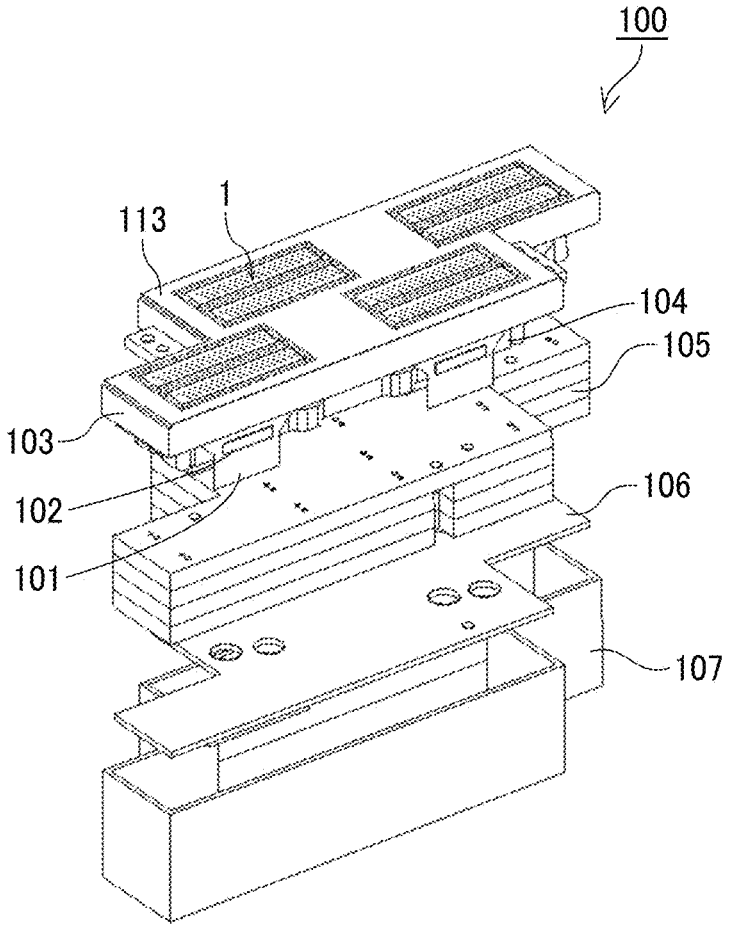
FIG. 27 is an exploded perspective view of the head module viewed from a nozzle surface side of the head module.

FIGS. 26 and 27 illustrate an example of a head module according to an embodiment of the present disclosure. FIG. 26 is an exploded perspective view of a head module 100.

FIG. 27 is an exploded perspective view of the head module 100 viewed from a nozzle surface side of the head module 100.

The head module 100 includes a plurality of heads 1 configured to discharge a liquid, a base 103 that holds the plurality of heads 1, and a cover 113 serving as a nozzle cover of the plurality of heads 1.

Further, the head module 100 includes a heat radiating member 104, a manifold 105 forming a flow path to supply liquid to the plurality of heads 1, a printed circuit board 106 (PCB) connected to the substrate 101 (flexible wiring substrate), and a module case 107.

Figure 28:
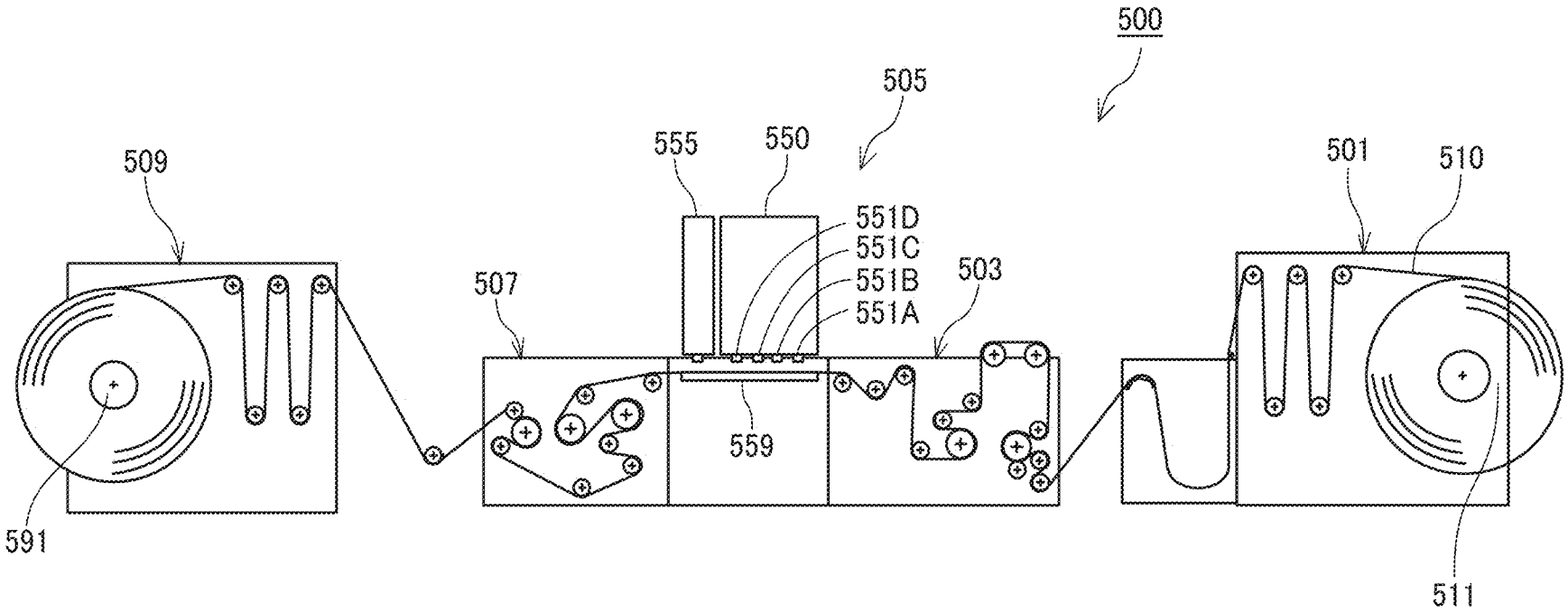
FIG. 28 is a schematic side view of a liquid discharge apparatus according to the present disclosure.
Figure 29:
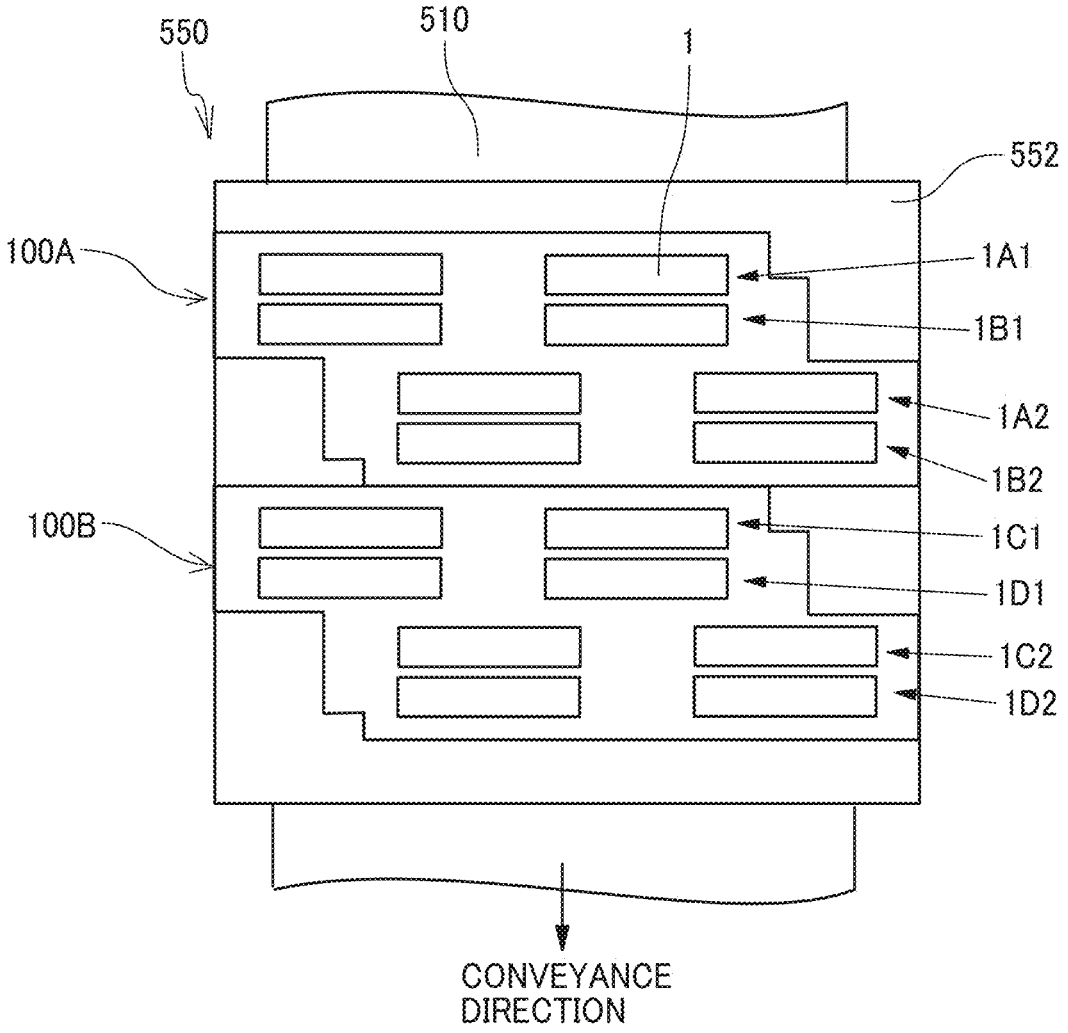
FIG. 29 is a plan view of a head unit of the liquid discharge apparatus of FIG. 28.

FIGS. 28 and 29 illustrate an example of a liquid discharge apparatus (printing apparatus 500) according to the present disclosure. FIG. 28 is a side view of a liquid discharge apparatus (printing apparatus 500) according to the present disclosure. FIG. 29 is a plan view of a head unit 550 of the liquid discharge apparatus (printing apparatus 500) of FIG. 28 according to the present disclosure.

The liquid discharge apparatus (printing apparatus 500) according to the present disclosure includes a feeder 501 to feed a continuous medium 510, a guide conveyor 503 to guide and convey the continuous medium 510 fed from the feeder 501 to a printing unit 505, the printing units 505 and 555 to discharge liquid onto the continuous medium 510 to form an image on the continuous medium 510, a drier unit 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the drier unit 507, and wound around a take-up roller 591 of the ejector 509.

In the printing unit 505, the continuous medium 510 is conveyed opposite the head unit 550 on a conveyance guide 559. The head unit 550 discharges a liquid from the nozzles 11 of the head 1 to form an image on the continuous medium 510.

The head unit 550 includes four head devices 551A to 551D to discharge liquid of respective colors such as yellow, magenta, cyan, and black.

Here, the head devices 551A to 551D in the head unit 550 respectively includes two head modules 100A and 100B according to the present disclosure in the common base member 552.

The head module 100A includes head arrays 1A1, 1B1, 1A2, and 1B2. Each of the head arrays 1A1, 1B1, 1A2, and 1B2 includes a plurality of heads 1 arranged in a direction perpendicular to a conveyance direction of the continuous medium 510. The head module 100B includes head arrays 1C1, 1D1, 1C2, and 1D2. Each of the head arrays 1C1, 1D1, 1C2, and 1D2 includes a plurality of heads 1 arranged in a direction perpendicular to the conveyance direction of the continuous medium 510. The head 1 in each of the head arrays 1A1 and 1A2 of the head module 100A discharges liquid of the same color. Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquid of the same color.

Figure 30:
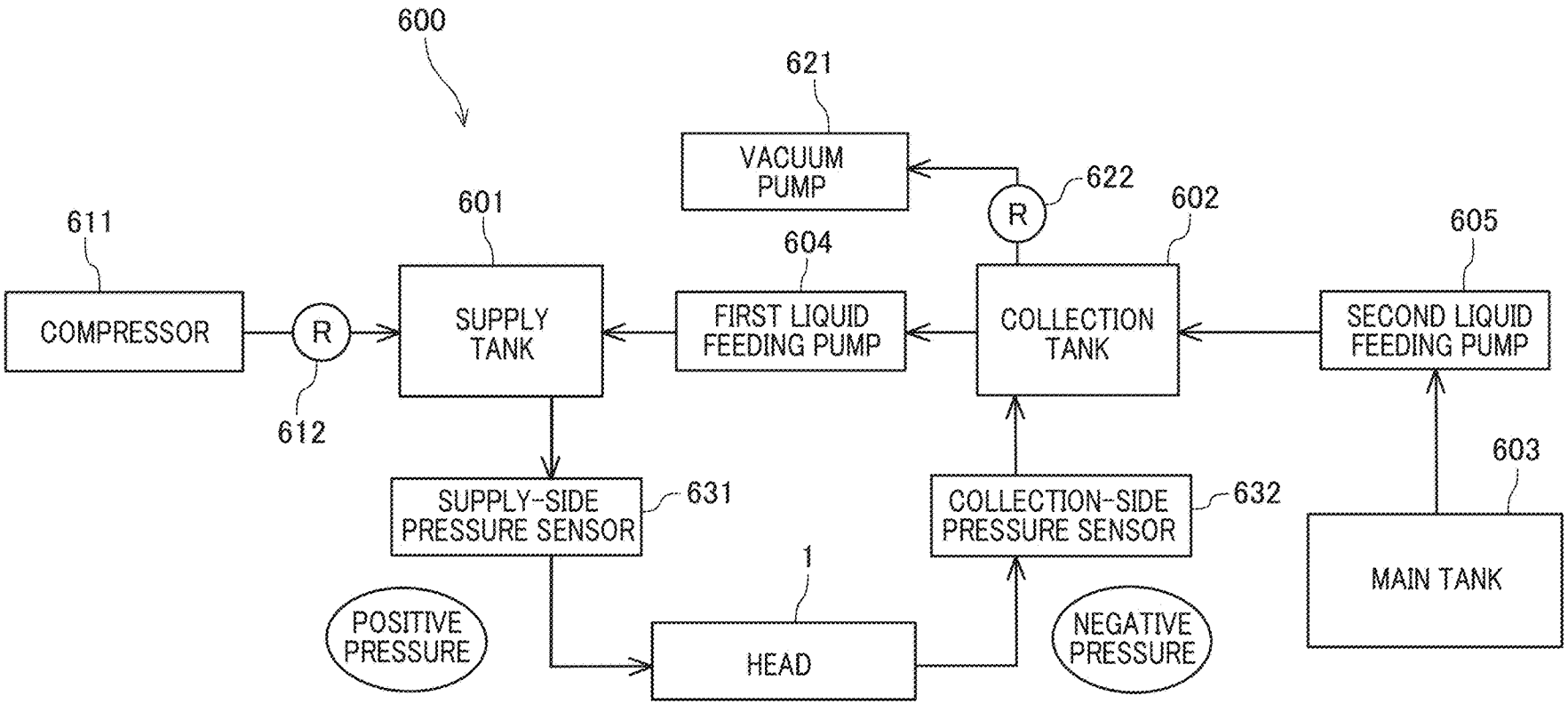
FIG. 30 is a circuit diagram illustrating an example of a liquid circulation device according to the present disclosure.

FIG. 30 illustrates an example of a liquid circulation device 600 employed in the liquid discharge apparatus (printing apparatus 500) according to the present disclosure. FIG. 30 is a circuit diagram illustrating a structure of the liquid circulation device 600. Although only one head 1 is illustrated in FIG. 30, in the structure including a plurality of heads 1 as illustrated in FIGS. 28 to 29, supply channels and collection channels are coupled via manifolds or the like to the supply sides and collection sides of the plurality of heads 1. The head 1 of a circulation type in the third embodiment is used as the head 1.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, and a supply-side pressure sensor 631, and a collection-side pressure sensor 632.

The compressor 611 and the vacuum pump 621 together generate a difference of pressure between the pressure in the supply tank 601 and the pressure in the collection tank 602.

The supply-side pressure sensor 631 is connected between the supply tank 601 and the head 1 and connected to the supply channels connected to the supply port 81 of the head 1. The collection-side pressure sensor 632 is connected between the head 1 and the collection tank 602 and is connected to the collection channels connected to the collection port 82 of the head 1.

One of the collection tanks 602 is connected to the supply tank 601 via the first liquid feed pump 604, and the other of the collection tanks 602 is connected to the main tank 603 via the second liquid feed pump 605.

Accordingly, the liquid flows from the supply tank 601 into the head 1 via the supply port 81 and exits the head 1 from the collection port 82 into the collection tank 602. Further, the first liquid feed pump 604 feeds the liquid from the collection tank 602 to the supply tank 601. Thus, the liquid circulation channel is constructed.

Here, a compressor 611 is connected to the supply tank 601 and is controlled so that a predetermined positive pressure is detected by the supply-side pressure sensor 631. Conversely, a vacuum pump 621 is connected to the collection tank 602 and is controlled so that a predetermined negative pressure is detected by the collection-side pressure sensor 632.

Such a configuration allows the menisci of ink to be maintained at a constant negative pressure while circulating liquid through the inside of the head 1.

When droplets are discharged from the nozzles 11 of the head 1, the amount of liquid in each of the supply tank 601 and the collection tank 602 decreases. Therefore, the liquid is replenished from the main tank 603 to the collection tank 602 using the second liquid feeding pump 605 as appropriate.

The timing of supply of liquid from the main tank 603 to the collection tank 602 can be controlled in accordance with a result of detection by a liquid level sensor in the collection tank 602. For example, the liquid is supplied to the collection tank 602 from the main tank 603 when the liquid level in the collection tank 602 becomes lower than a predetermined height.

Figure 31:
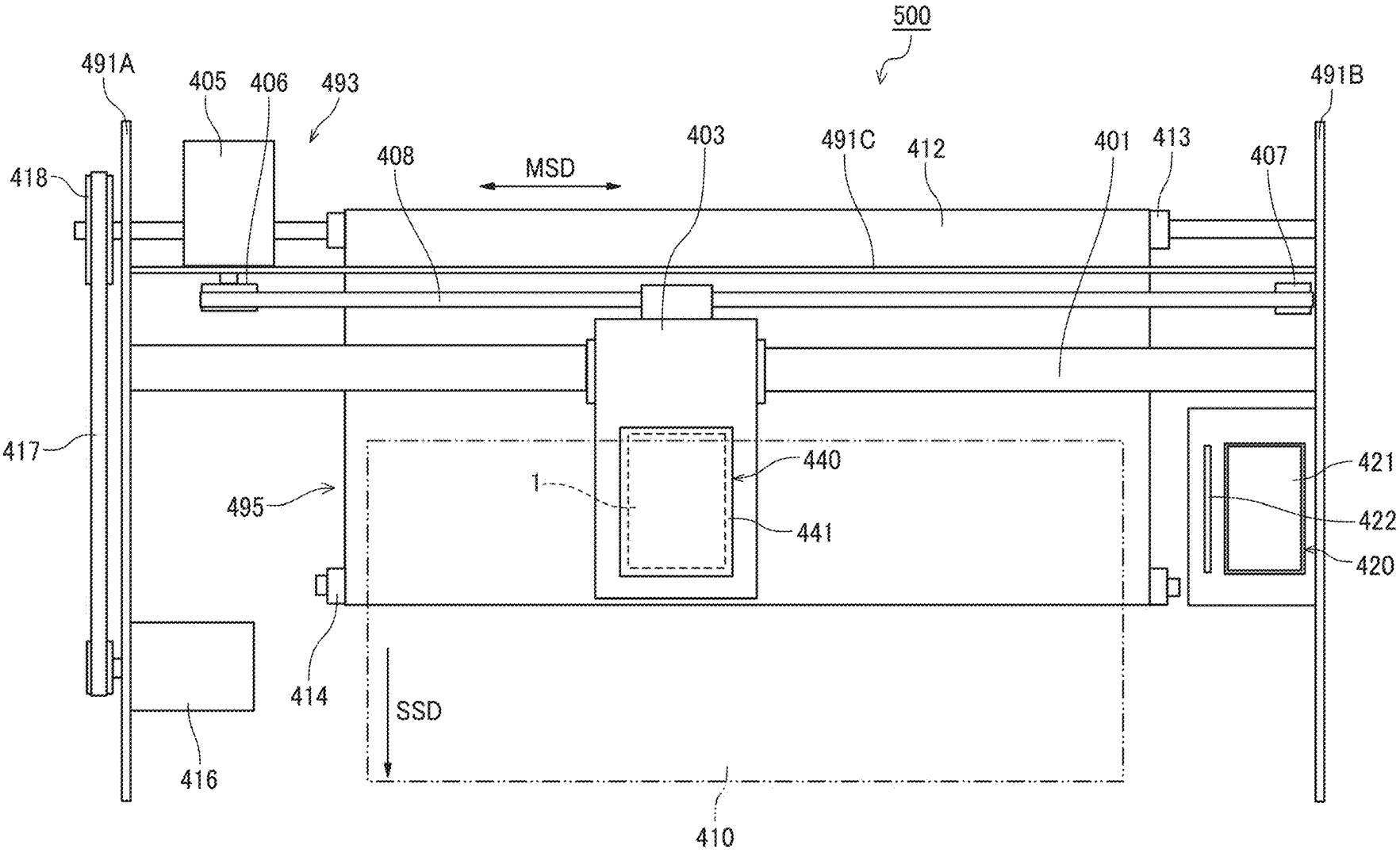
FIG. 31 is a plan view of a portion of a printer as a liquid discharge apparatus according to the present disclosure.
Figure 32:
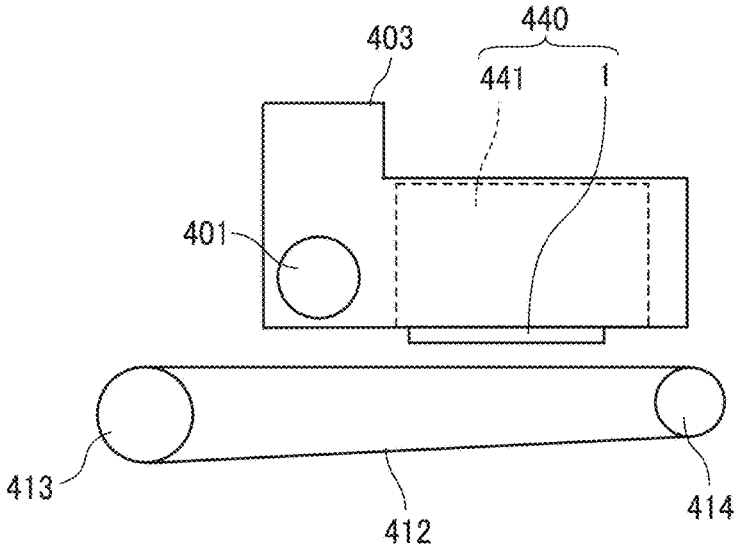
FIG. 32 is a schematic side view of a main portion of the liquid discharge apparatus.

Next, another example of the printing apparatus 500 as a liquid discharge apparatus according to the present disclosure is described with reference to FIGS. 31 and 32. FIG. 31 is a plan view of a portion of the printing apparatus 500. FIG. 32 is a side view of a portion of the printing apparatus 500 of FIG. 31.

The printing apparatus 500 is a serial type apparatus, and the carriage 403 is reciprocally moved in the main scanning direction MSD by the main scan moving unit 493. The main scanning moving unit 493 includes a guide member 401, a main scanning motor 405, a timing belt 408, and the like. The guide member 401 is bridged between a left side plate 491A and a right-side plate 491B to moveably hold the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 1 according to the present disclosure and a head tank 441 forms the liquid discharge device 440 as a single unit. The head 1 of the liquid discharge device 440 discharges liquid of each color, for example, yellow (Y), cyan (C), magenta (M), and black (K). The head 1 includes a nozzle array 12 including a plurality of nozzles 11 arrayed in array in a sub-scanning direction SSD perpendicular to the main scanning direction indicated by array MSD in FIG. 31. The head 1 is mounted to the carriage 403 so that ink droplets are discharged downward.

The head 1 is connected to the liquid circulation device 600 described above, and a liquid of a required color is circulated and supplied.

The printing apparatus 500 includes a conveyor 495 to convey a medium 410 (sheet). The conveyor 495 includes a conveyance belt 412 as a conveyor and a sub-scanning motor 416 to drive the conveyance belt 412.

The conveyance belt 412 attracts the medium 410 and conveys the medium 410 at a position facing the head 1. The conveyance belt 412 is an endless belt and is stretched between a conveyance roller 413 and a tension roller 414. Attraction of the medium 410 to the conveyance belt 412 may be applied by electrostatic adsorption, air suction, or the like.

The conveyance belt 412 rotates in the sub-scanning direction as indicated by arrow SSD as the conveyance roller 413 is rotationally driven by the sub-scanning motor 416 via the timing belt 417 and the timing pulley 418.

At one side in the main scanning direction MSD of the carriage 403, a maintenance unit 420 to maintain the head 1 in good condition is disposed on a lateral side of the conveyance belt 412.

The maintenance unit 420 includes, for example, a cap 421 to cap the nozzle surface of the head 1 and a wiper 422 to wipe the nozzle surface of the head 1.

The main scan moving unit 493, the maintenance unit 420, and the conveyor 495 are mounted to a housing that includes a left side plate 491A, a right-side plate 491B, and a rear side plate 491C.

In the printing apparatus 500 thus configured, the medium 410 is conveyed on and attracted to the conveyance belt 412 and is conveyed in the sub-scanning direction SSD by the cyclic rotation of the conveyance belt 412.

The head 1 is driven in response to image signals while the carriage 403 moves in the main scanning direction MSD, to discharge liquid to the medium 410 stopped, thus forming an image on the medium 410.

Figure 33:
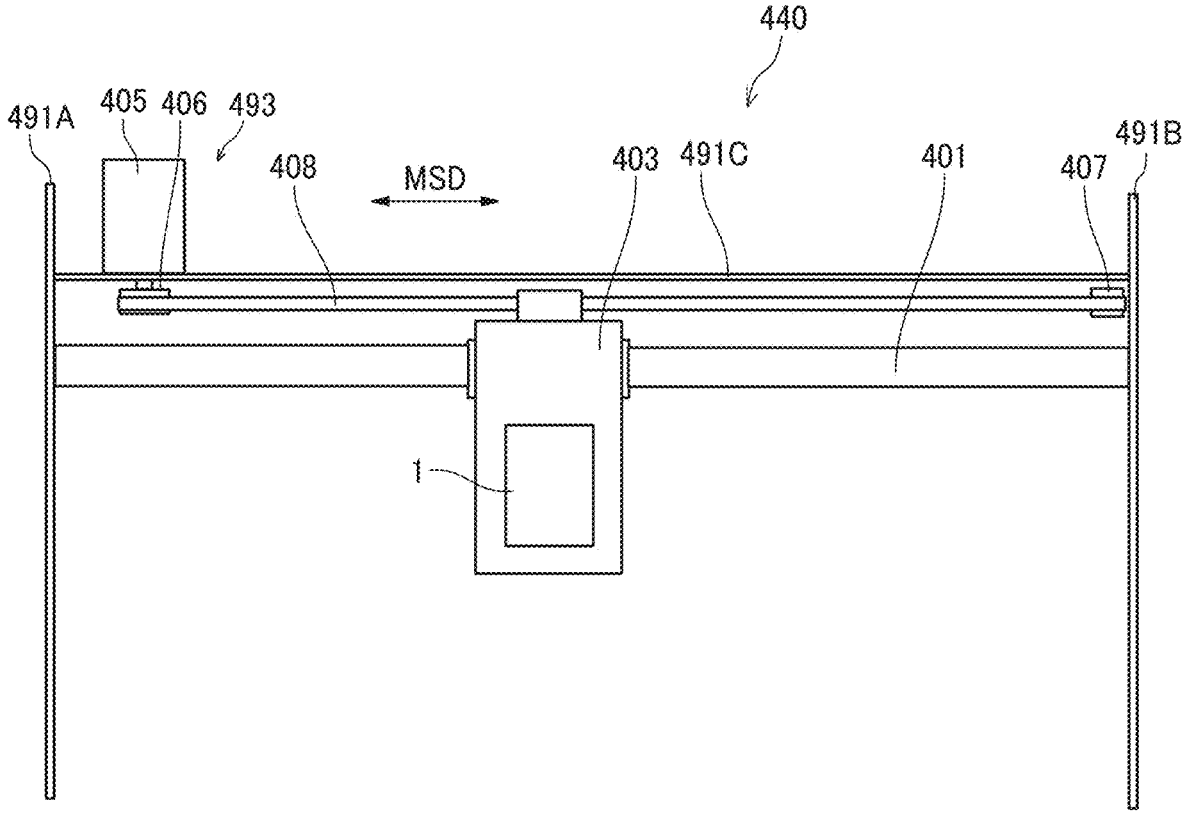
FIG. 33 is a plan view of a portion of another example of a liquid discharge device.

Next, the liquid discharge device 440 according to another embodiment of the present disclosure is described with reference to FIG. 33. FIG. 33 is a plan view of a portion of another example of the liquid discharge device 440.

The liquid discharge device 440 includes a housing, the main scan moving unit 493, the carriage 403, and the head 1 among components of the printing apparatus 500. The left side plate 491A, the right-side plate 491B, and the rear side plate 491C constitute the housing.

Note that, in the liquid discharge device 440, the maintenance unit 420 described above may be mounted on, for example, the right-side plate 491B.

Figure 34:
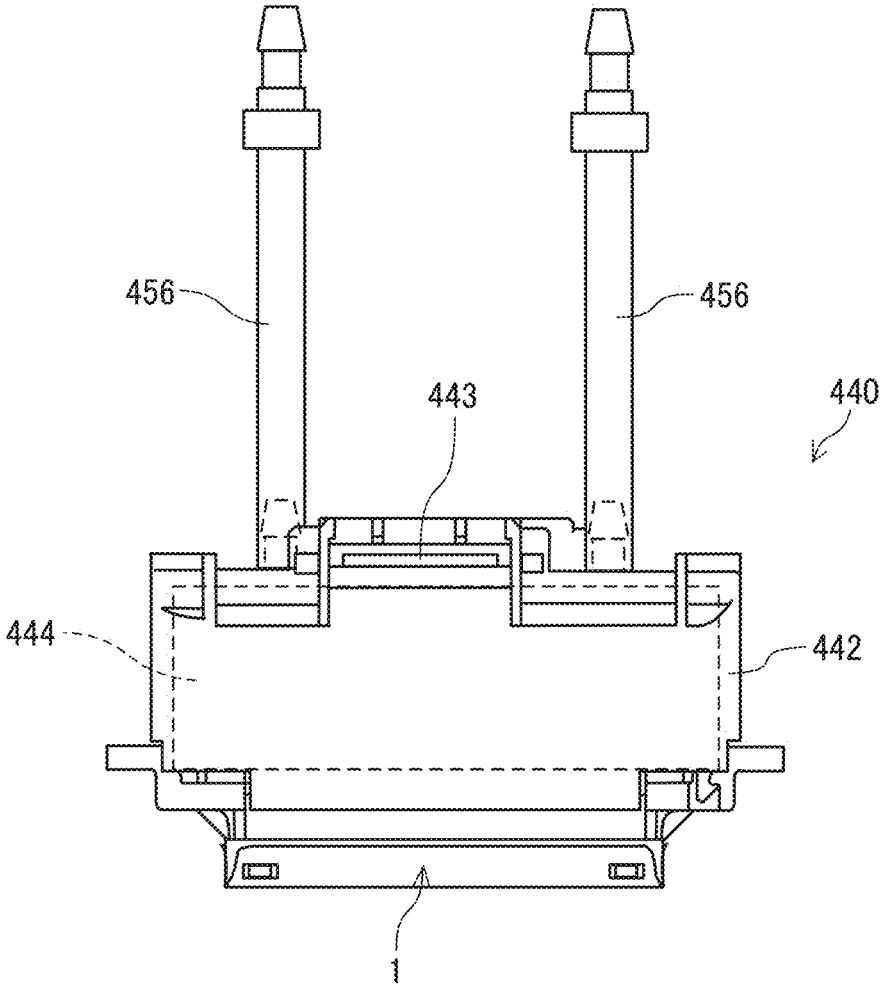
FIG. 34 is a front view of the liquid discharge device according to still another embodiment of the present disclosure.

Next, still another example of the liquid discharge device 440 according to the present disclosure is described with reference to FIG. 34. FIG. 34 is a front view of still another example of the liquid discharge device 440.

The liquid discharge device 440 includes the head 1, to which a channel part 444 is attached, and a tube 456 connected to the channel part 444.

Further, the channel part 444 is disposed inside a cover 442. Instead of the channel part 444, the liquid discharge device 440 may include the head tank 441. A connector 443 electrically connected with the head 1 is provided on an upper part of the channel part 444.

In the present disclosure, discharged liquid is not limited to a particular liquid as long as the liquid has a viscosity or surface tension to be discharged from a head (liquid discharge head). However, preferably, the viscosity of the liquid is not greater than 30 mPa s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head tank or the channel member mounted on the head so that the head and a supply unit form a single unit. Liquid is supplied from a liquid reservoir source to the head via the tube.

The main scan moving unit may be a guide only. The supply unit may be a tube(s) only or a loading unit only.

The "liquid discharge device" includes a head module including the above-described head, the head module, and head device in which the above-described functional components and mechanisms are combined to form a single unit.

The term "liquid discharge apparatus" used herein also represents an apparatus including the head, the liquid discharge device, the head module, and the head device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzle arrays arranged in a first direction, wherein the plurality of nozzle arrays each includes nozzles from which a liquid is discharged, the nozzles arranged in a second direction intersecting the first direction, and one of two nozzle arrays of the plurality of nozzle arrays adjacent to each other in the first direction include at least two nozzles arranged at different nozzle intervals from corresponding nozzles of another of the two nozzle arrays in the first direction.

2. The liquid discharge head according to claim 1, wherein two nozzles arrays of the plurality of nozzle arrays are arranged at an end part of the liquid discharge head in the first direction, the two nozzle arrays include:

first nozzles arranged at a first nozzle interval wider than a nozzle interval of nozzles arranged at a central part of the liquid discharge head in the first direction; and second nozzles arranged at a second nozzle interval narrower than a nozzle interval of nozzles arranged at the central part of the liquid discharge head in the first direction.

3. The liquid discharge head according to claim 1, wherein two nozzle arrays of the plurality of nozzle arrays adjacent to each other in the first direction include nozzles arranged at a constant nozzle interval in the first direction.

4. The liquid discharge head according to claim 1, further comprising a plurality of nozzle array groups each including the plurality of nozzle arrays, wherein nozzle intervals of the nozzles are different between the plurality of nozzle array groups.

5. A head module comprising a plurality of liquid discharge heads including the liquid discharge head according to claim 1, wherein the plurality of liquid discharge heads is arrayed in one direction.

6. A head device comprising a plurality of head modules including the head module according to claim 5, wherein the plurality of head modules is arrayed in the one direction.

7. A liquid discharge device comprising the head device according to claim 6.

8. The liquid discharge device according to claim 7, wherein the liquid discharge head is integrated with at least one of:

a head tank configured to store the liquid to be supplied to the liquid discharge head, a carriage on which the liquid discharge head is mounted, a supply unit configured to supply the liquid to the liquid discharge head, a recovery device configured to maintain the liquid discharge head, and a main scan moving unit configured to move the liquid discharge head in a main scanning direction.

9. A liquid discharge apparatus comprising:

a liquid discharge head configured to discharge a liquid; and a conveyor configured to convey a medium, onto which the liquid discharged from the liquid discharge head is applied, in a conveyance direction, wherein the liquid discharge head includes:

a plurality of nozzle arrays arranged in a first direction perpendicular to the conveyance direction, the plurality of nozzle arrays each includes nozzles from which the liquid is discharged, the nozzles arranged in a second direction intersecting the first direction, and one of two nozzle arrays of the plurality of nozzle arrays adjacent to each other in the first direction includes at least two nozzles arranged at different nozzle intervals from corresponding nozzles of another of the two nozzle arrays in the first direction.

10. The liquid discharge apparatus according to claim 9, wherein two nozzle arrays of the plurality of nozzle arrays are arranged at an end part of the liquid discharge head in the first direction, and the two nozzle arrays include:

first nozzles arranged at an upstream in the conveyance direction, the first nozzles arranged at a first nozzle interval wider than a nozzle interval of nozzles arranged at a central part of the liquid discharge head in the first direction; and second nozzles arranged at a downstream of the first nozzles in the conveyance direction, the second nozzles arranged at a second nozzle interval narrower than a nozzle interval of nozzles arranged at the central part of the liquid discharge head in the first direction.

11. The liquid discharge apparatus according to claim 10, wherein a number of the plurality of nozzle arrays including the first nozzles is larger than a number of the plurality of nozzle arrays including the second nozzles.

12. The liquid discharge apparatus according to claim 9, wherein nozzles disposed at a same stage in the second direction in each of the plurality of nozzle arrays arranged in the first direction include:

first nozzles arranged at an upstream in the conveyance direction, the first nozzles arranged at a first nozzle interval wider than a nozzle interval of nozzles arranged at a central part of the liquid discharge head in the first direction; and second nozzles arranged at a downstream of the first nozzles in the conveyance direction, the second nozzles arranged at a second nozzle interval narrower than a nozzle interval of nozzles arranged at the central part of the liquid discharge head in the first direction.

13. The liquid discharge apparatus according to claim 12, wherein a number of the plurality of nozzle arrays including the first nozzles is larger than a number of the plurality of nozzle arrays including the second nozzles.

* * * * *